US011854524B2

(12) United States Patent
Bastyr

(10) Patent No.: US 11,854,524 B2
(45) Date of Patent: Dec. 26, 2023

(54) ADAPTIVE ACTIVE NOISE CANCELLATION BASED ON HEAD MOVEMENT

(71) Applicant: HARMAN INTERNATIONAL INDUSTRIES, INCORPORATED, Stamford, CT (US)

(72) Inventor: Kevin J. Bastyr, Franklin, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 6 days.

(21) Appl. No.: 17/473,963

(22) Filed: Sep. 13, 2021

(65) Prior Publication Data

US 2023/0085506 A1 Mar. 16, 2023

(51) Int. Cl.
*G10K 11/175* (2006.01)
*H04R 3/02* (2006.01)

(52) U.S. Cl.
CPC ..... *G10K 11/1752* (2020.05); *H04R 3/02* (2013.01); *H04R 2499/13* (2013.01)

(58) Field of Classification Search
CPC ... G10K 11/1752; H04R 3/02; H04R 2499/13
USPC ..... 381/86
See application file for complete search history.

(56) References Cited

U.S. PATENT DOCUMENTS

| | | | |
|---|---|---|---|
| 10,106,080 | B1 | 10/2018 | Hassani et al. |
| 10,403,258 | B2 | 9/2019 | Zafeiropoulos |
| 2014/0226831 | A1 | 8/2014 | Tzirkel-Hancock et al. |
| 2016/0329040 | A1* | 11/2016 | Whinnery ..... G10K 11/17853 |
| 2020/0366987 | A1 | 11/2020 | Furuta et al. |
| 2021/0225349 | A1 | 7/2021 | Seffernick et al. |

FOREIGN PATENT DOCUMENTS

WO 2022/031279 A1 2/2022

OTHER PUBLICATIONS

Patent application entitled, "Occupancy Based Active Noise Cancellation Systems", serial No. PCT/US2020/044961, filed Aug. 5, 2020, 31 pages.

* cited by examiner

*Primary Examiner* — Vivian C Chin
*Assistant Examiner* — Douglas J Suthers
(74) *Attorney, Agent, or Firm* — Artegis Law Group, LLP

(57) ABSTRACT

Adjustment of active noise cancellation (ANC) systems can include determining a noise within a vehicle; detecting a movement of a head of a listener; adjusting one or more parameters of the ANC system based at least on the noise and the movement of the head of the listener; determining an anti-noise based at least on the adjusted one or more parameters; and outputting the anti-noise.

19 Claims, 8 Drawing Sheets

ADAPTIVE ACTIVE NOISE CANCELLATION BASED ON HEAD MOVEMENT

BACKGROUND

Field of the Various Embodiments

The present disclosure is directed to an active noise cancellation system and, more particularly, to adaptive active noise cancellation based on head movement.

Description of the Related Art

Active Noise Cancellation (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is identical or similar in magnitude and frequency but opposite in phase to the noise, reduce the sound pressure level (SPL) at a location. In a vehicle cabin listening environment, potential sources of undesired noise come from the engine, the exhaust system, the interaction between the tires of the vehicle and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is an ANC system implemented on a vehicle in order to minimize undesirable road noise inside the vehicle cabin. RNC systems use vibration and/or other sensors to sense road induced vibration generated from the tire and road interface that leads to unwanted audible road noise. This unwanted road noise inside the cabin is then cancelled, or reduced in level, by using speakers to generate sound waves that are ideally opposite in phase and identical or similar in magnitude and frequency to the noise to be reduced at the ears of one or more listeners. Cancelling such road noise results in a more pleasurable ride for vehicle passengers, and it enables vehicle manufacturers to use lightweight materials, thereby decreasing energy consumption and reducing emissions.

An Engine Order Cancellation (EOC) system is a specific ANC system implemented on a vehicle in order to minimize undesirable engine noise inside the vehicle cabin. For example, an engine noise of the vehicle can include one or more engine orders, or noise frequencies at different harmonic multiples of a base frequency, which can vary in frequency based on an engine speed (e.g., engine revolutions per minute, or RPM). The audio sampling of the engine and/or the reference signal can be used to generate sound waves that are opposite in phase to the engine noise that is audible in the vehicle interior.

RNC systems are typically designed to cancel broadband signals, while EOC systems are designed and optimized to cancel narrowband signals, such as individual engine orders. ANC systems within a vehicle can provide both RNC and EOC technologies. Such vehicle-based ANC systems are typically Least Mean Square (LMS) adaptive feed-forward systems that continuously adapt W-filters based on noise inputs (e.g., acceleration inputs from the vibration sensors in an RNC system) and signals of physical microphones located in various positions inside the cabin of the vehicle. A feature of LMS-based feed-forward ANC systems and corresponding algorithms is the storage of the impulse response, or secondary path, between each physical microphone and each anti-noise speaker in the system. The secondary path is the transfer function between an anti-noise generating speaker and a physical microphone, essentially characterizing how an electrical anti-noise signal becomes sound that is radiated from the speaker, travels through a vehicle cabin to a physical microphone, and becomes the microphone output signal.

A virtual or remote microphone technique is a method in which an ANC system estimates an error signal generated by an imaginary or virtual microphone at a remote location where no real physical microphone is located, based on the error signals received from one or more real physical microphones. This virtual or remote microphone technique can improve noise cancellation at the ears of a listener even when no physical microphone is actually located there.

A first drawback of such ANC systems is the non-uniformity of the noise and anti-noise in the region around the head of the listener. For example, the noise field created by the road noise and/or engine noise can be non-uniform in the region around the head of the listener. Similarly, the anti-noise field generated by the ANC system can be non-uniform in the region around the head of the listener. Thus, an anti-noise field that is generated to cancel road noise and/or engine noise can be effective while the head of the listener is in a first disposition, such as a first position and/or orientation (i.e., vertical, transverse, lateral, pitch, yaw, and/or tilt), but can be less effective while the head of the listener is in a second disposition, such as a second position and/or orientation. That is, while the head of the listener is in the first disposition, the anti-noise can destructively interfere with the noise at positions near the ears of a listener. However, while the head of the listener is in the second disposition, the anti-noise can destructively interfere with the noise at a position near the ears of the listener to a lesser extent, or can constructively interfere, thus amplifying the noise perceived by the listener. As another example, while the head of the listener is in the first position and/or orientation, the destructive interference of the noise and anti-noise in the region at the left and right ears of the listener can be similar. However, while the head of the listener is in the second position and/or orientation, the destructive interference of the noise and anti-noise in these two regions can vary, which can create an undesirable imbalance in the noise perceived by the left ear and right ear of the listener. These differences can occur or can be amplified by the difficulty in determining or estimating the noise or anti-noise at the position of the head or ears of the listener based on the noise or anti-noise detected by a microphone, e.g., according to the virtual or remote microphone technique. As a result of these properties, undesirable changes in the noise cancellation perceived at the ears of the listener as the head of the listener moves can be noticeable, uncomfortable or distracting.

A second drawback of such ANC systems is a delay between the detection of the road and/or engine noise and the generation of the anti-noise field, for example, due to a duration in creating or radiating the anti-noise field and/or due to a stability limitation in which adapting the W-filters too quickly can result in undesirable discrepancies between the noise field and the anti-noise field. As a result of such delay, a period of time can occur between the placement of the head of the listener in a particular disposition orientation and the adaptation of the anti-noise field to cancel the noise field based on the disposition. This period can be particularly protracted in the case of road noise, due to a typically broad frequency spectrum of the road noise and the computational complexity of calculating the broadband anti-noise field to compensate for the broad frequency road noise spectrum. During this period, a generated anti-noise field based on a previous disposition of the head of the listener head can be mismatched with the noise field perceived by the listener in the current disposition of the head of the listener, and suboptimal noise cancellation can result.

As the foregoing illustrates, what is needed are techniques for adaptive active noise cancellation based on head movement.

SUMMARY

Embodiments are disclosed for controlling an active noise cancellation (ANC) system. Some embodiments can include determining a noise within a vehicle. Some embodiments can include detecting a movement of a head of a listener. Some embodiments can include adjusting one or more parameters of the ANC system based at least on the noise and/or the movement of the head of the listener. Some embodiments can include determining an anti-noise based at least on the adjusted one or more parameters. Some embodiments can include outputting the anti-noise signals via speakers to create an anti-noise.

Further embodiments provide, among other things, a system and a non-transitory computer-readable medium configured to implement the method set forth above.

At least one technical advantage of the disclosed techniques relative to the prior art is that, with the disclosed techniques, an ANC system can reduce the anti-noise during periods in which a mismatch between the noise and the anti-noise at the location of the head of the listener is likely to occur such as when the ANC system is unable to adapt quickly enough to a movement of the head of the listener to adjust the anti-noise to cancel the noise at the new position of the head of the listener. That is, the ANC system can reduce the anti-noise during periods in which destructive interference between the noise and the generated anti-noise at the location of an ear of a listener is likely to be reduced, and/or during which constructive interference between the noise and the generated anti-noise at the location of an ear of the listener is likely to occur. The ANC system can therefore reduce a period during which the anti-noise would undesirably increase a noise level, which can be uncomfortable, distracting, or potentially dangerous to the listener. These technical advantages provide one or more technological improvements over prior art approaches.

BRIEF DESCRIPTION OF THE DRAWINGS

So that the manner in which the above recited features of the various embodiments can be understood in detail, a more particular description of the inventive concepts, briefly summarized above, can be had by reference to various embodiments, some of which are illustrated in the appended drawings. It is to be noted, however, that the appended drawings illustrate only typical embodiments of the inventive concepts and are therefore not to be considered limiting of scope in any way, and that there are other equally effective embodiments.

DETAILED DESCRIPTION

In the following description, numerous specific details are set forth to provide a more thorough understanding of the various embodiments. However, the inventive concepts can be practiced without one or more of these specific details.

Road Noise Cancellation (RNC) and Engine Order Cancellation (EOC)

Figure 1:
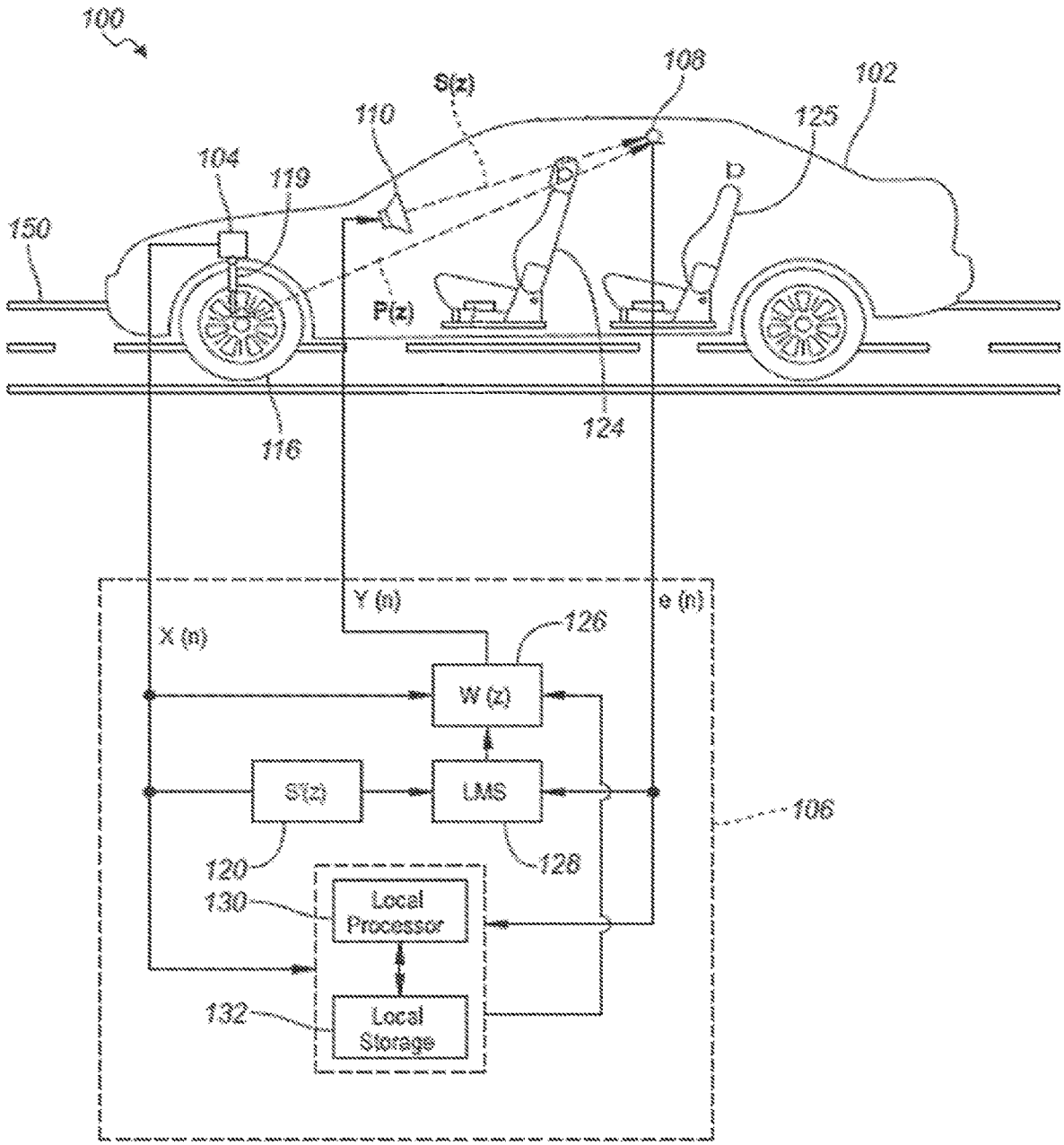
FIG. 1 is a block diagram of a vehicle having an active noise cancellation (ANC) system, according to one or more aspects of the various embodiments.

FIG. 1 is a block diagram of a vehicle 102 having an active noise cancellation (ANC) system 100, according to one or more aspects of the various embodiments. As shown in FIG. 1, the RNC system 106 is depicted within a vehicle 102 having one or more vibration sensors 104. The vibration sensors 104 are disposed throughout the vehicle 102 to monitor the vibratory behavior of the suspension of the vehicle, subframe of the vehicle, as well as other axle and chassis components of the vehicle. The RNC system 106 can be integrated with a broadband adaptive feed-forward and feedback active noise cancellation (ANC) system 100 that generates anti-noise by adaptively filtering the signals from the vibration sensors 104 using one or more physical microphones 108. The anti-noise signal can then be played through one or more loudspeakers, or speakers 110 to become sound. S(z) represents a transfer function between a single speaker 110 and a single microphone 108. While FIG. 1 shows a single vibration sensor 104, microphone 108, and speaker 110 for simplicity purposes only, it should be noted that RNC system 106 can use multiple vibration sensors 104 (e.g., ten or more), microphones 108 (e.g., four to six), and speakers 110 (e.g., four to eight). As described in further detail below, the ANC system 100 can also include one or more virtual microphones that are used for adapting anti-noise signal(s) that are optimized for listeners in the vehicle 102 at a given time, according to one or more embodiments.

The vibration sensors 104 can include, but are not limited to, accelerometers, force gauges, geophones, linear variable differential transformers, strain gauges, load cells, or the like. Accelerometers, for example, are devices whose output signal amplitude is proportional to acceleration. A wide variety of accelerometers are available for use in RNC system 106. These include accelerometers that are sensitive to vibration in one, two and three typically orthogonal directions. These multi-axis accelerometers typically have a separate electrical output (or channel) for vibration sensed in their X-direction, Y-direction and Z-direction. Single-axis and multi-axis accelerometers, therefore, can be used as vibration sensors 104 to detect the magnitude and phase of acceleration and can also be used to sense orientation, motion, and vibration.

Noise and vibration that originates from a wheel 116 moving on a road surface 150 can be sensed by one or more of the vibration sensors 104 mechanically coupled to a suspension device 119 or a chassis component of the vehicle 102. The vibration sensor 104 can output a noise signal X(n), which is a vibration signal that represents the detected road-induced vibration. It should be noted that multiple vibration sensors are possible, and their signals can be used separately, or can be combined. In certain embodiments, a microphone can be used in place of a vibration sensor to output the noise signal X(n) indicative of noise generated from the interaction of the wheel 116 and the road surface 150. The noise signal X(n) can be filtered with a modeled transfer characteristic S'(z), which estimates the secondary path (i.e., the transfer function between an anti-noise speaker 110 and a physical microphone 108), by a secondary path filter 120.

Road noise that originates from the interaction of the wheel 116 and the road surface 150 is also transferred, mechanically and/or acoustically, into the passenger cabin and is received by the one or more microphones 108 inside the vehicle 102. The one or more microphones 108 can, for example, be located in a headliner of the vehicle 102, or in some other suitable location to sense the acoustic noise heard by listeners inside the vehicle 102, such as a listener sitting on a rear seat 125. The road noise originating from the interaction of the road surface 150 and the wheel 116 is transferred to the microphone 108 according to a transfer characteristic P(z), which represents the primary path (i.e., the transfer function between an actual noise source and a physical microphone).

The microphone 108 can output an error signal e(n) representing the sound present in the cabin of the vehicle 102 as detected by the microphone 108, including noise and anti-noise. In the RNC system 106, an adaptive transfer characteristic W(z) of a controllable W-filter 126 can be controlled by adaptive filter controller 128, which can operate according to a known least mean square (LMS) algorithm based on the error signal e(n) and the noise signal X(n) filtered with the modeled transfer characteristic S'(z) by the filter 120. The controllable W-filter 126 is often referred to as a W-filter. An anti-noise signal Y(n) can be generated by an adaptive filter formed by the controllable W-filter 126 and the adaptive filter controller 128 based on the identified transfer characteristic W(z) and the vibration signal, or a combination of vibration signals X(n). The anti-noise signal Y(n) ideally has a waveform such that when played through the speaker 110, anti-noise is generated near the ears of the listeners and the microphone 108 that is substantially opposite in phase and identical or similar in magnitude and frequency to that of the road noise audible to the listeners of the vehicle cabin. The anti-noise from the speaker 110 can combine with road noise in the vehicle cabin near the microphone 108 resulting in a reduction of road noise-induced sound pressure level (SPL) at this location. In certain embodiments, the RNC system 106 can receive sensor signals from other acoustic sensors in the passenger cabin, such as an acoustic energy sensor, an acoustic intensity sensor, or an acoustic particle velocity or acceleration sensor to generate error signal e(n).

While the vehicle 102 is under operation, a processor 130 can collect and optionally process the data from the occupant movement sensors 628 or other sensors. The data collected can be stored locally at a storage 132, or in the cloud, for future use by the vehicle 102. Examples of the types of data related to the RNC system 106 that can be useful to store locally at storage 132 include, but are not limited to, secondary paths, the transfer function between the physical and virtual microphone location H(z), preferred physical or virtual microphone sets, and preferred speaker sets. In some embodiments, the processor 130 and storage 132 can be integrated with one or more RNC system controllers, such as the adaptive filter controller 128.

As previously described, RNC system 106 can use several vibration sensors, microphones and speakers to sense structure-borne vibratory behavior of a vehicle and generate anti-noise. The vibration sensor may be multi-axis accelerometers having multiple output channels. For instance, triaxial accelerometers typically have a separate electrical output for vibration sensed in the X-direction, Y-direction, and Z-direction. A typical configuration for an RNC system can have, for example, six physical microphones, six speakers, and twelve channels of acceleration signals coming from four triaxial accelerometers or six dual-axis accelerometers. Therefore, the RNC system will also include multiple S'(z) filters (i.e., secondary path filters 120) and multiple W(z) filters (i.e., controllable W-filters 126).

Figure 2:
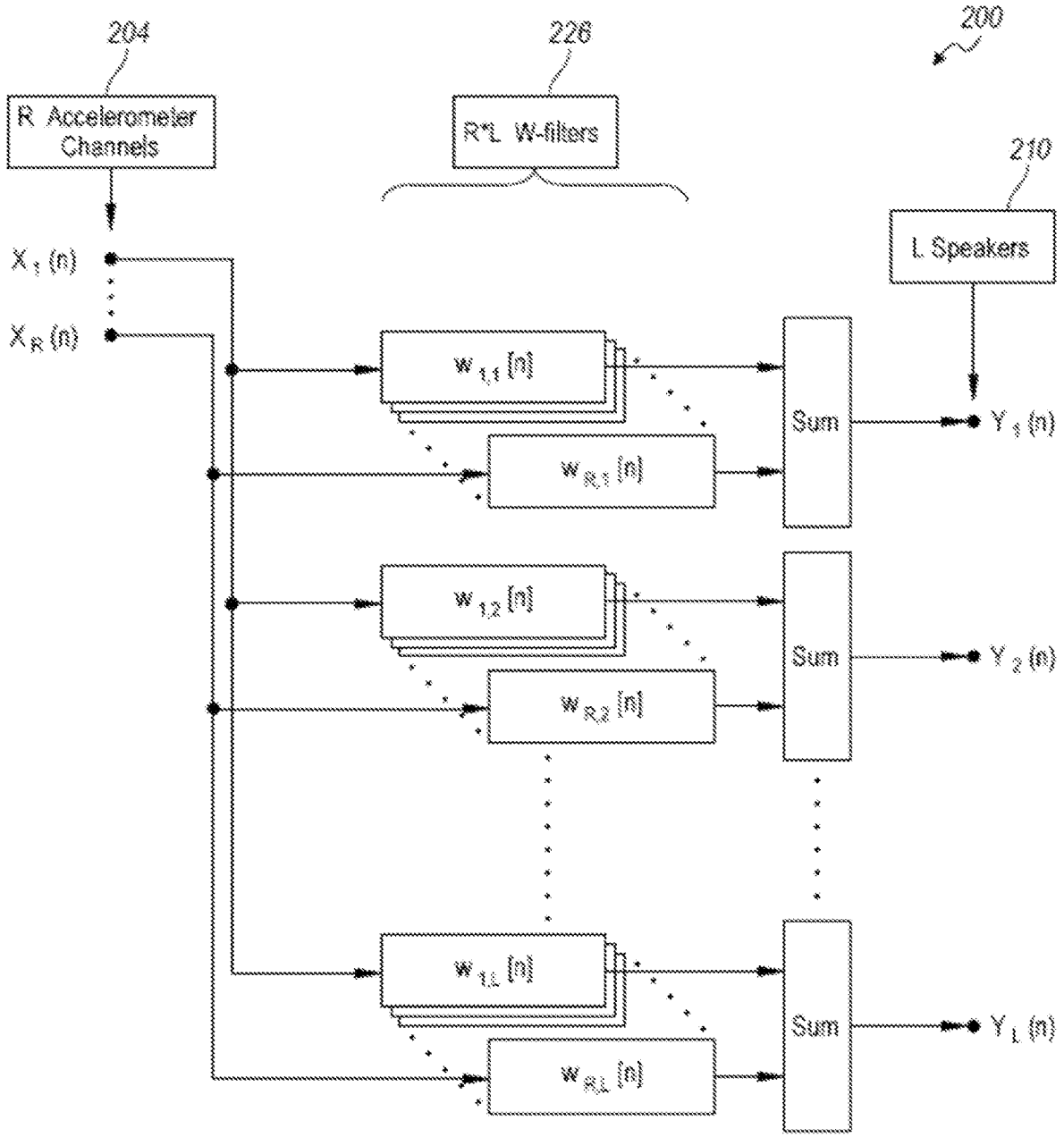
FIG. 2 is a sample schematic diagram of an RNC system, in accordance with one or more embodiments.

The simplified RNC system schematic depicted in FIG. 1 shows one secondary path, represented by S(z), between the speaker 110 and the microphone 108. As previously mentioned, RNC systems typically have multiple speakers, microphones and vibration sensors. Accordingly, a six-speaker, six-microphone RNC system will have thirty-six total secondary paths (i.e., 6×6). Correspondingly, the six-speaker, six-microphone RNC system can likewise have thirty-six S'(z) filters (i.e., secondary path filters 120), which estimate the transfer function for each secondary path. As shown in FIG. 1, an RNC system will also have one W(z) filter (i.e, controllable W-filter 126) between each noise signal X(n) from a vibration sensor (i.e., accelerometer) 104 and each speaker 110. Accordingly, a twelve-accelerometer signal, six-speaker RNC system can have seventy-two W(z) filters. The relationship between the number of accelerometer signals, speakers, and W(z) filters is illustrated in FIG. 2.

The ANC system 100 illustrated in FIG. 1 can also include an engine order cancellation (EOC) system. As mentioned above, EOC technology often uses a non-acoustic signal such as an engine speed signal representative of the engine crankshaft rotational speed as a reference in order to generate sound that is opposite in phase to the engine noise audible in the vehicle interior. EOC systems can utilize a narrowband feed-forward ANC framework to generate anti-noise using an engine speed signal to guide the generation of an engine order signal that is identical or similar in frequency to the engine order to be cancelled, and adaptively filter it to create an anti-noise signal. As one such example, an engine operating at an idle speed of 1200 RPM can generate engine noise including a first engine order of 20 Hz, a second engine order of 40 Hz, a fourth engine order of 80 Hz, and a eighth engine order of 160 Hz. In some embodiments, an EOC system can determine the engine noise based on an audio sampling of the engine noise using one or more microphones instead of or in addition to using a reference RPM signal.

After being transmitted via a secondary path from an anti-noise source to a listening position or physical microphone, the anti-noise ideally has the same amplitude, but opposite phase, as the combined sound generated by the engine and exhaust pipes after being filtered by the primary paths that extend from the engine to the listening position and from the exhaust pipe outlet to the listening position or physical or virtual microphone position. Thus, at the place where a physical microphone resides in the vehicle cabin (i.e., most likely at or close to the listening position), the superposition of engine order noise and anti-noise would ideally become zero so that acoustic error signal received by the physical microphone would only record sound other than the (ideally cancelled) engine order or orders generated by the engine and exhaust.

Commonly, a non-acoustic sensor, for example an engine speed sensor, is used as a reference. Engine speed sensors can be, for example, Hall Effect sensors which are placed adjacent to a spinning steel disk. Other detection principles can be employed, such as optical sensors or inductive sensors. The signal from the engine speed sensor can be used as a guiding signal for generating an arbitrary number of reference engine order signals corresponding to each of the engine orders. The reference engine orders form the basis for noise cancelling signals generated by the one or more narrowband adaptive feed-forward LMS blocks that form the EOC system.

Although the ANC system is described herein with reference to a vehicle, the techniques described herein are applicable to non-vehicle applications. For example and without limitation, an ANC system can be deployed in a room with fixed seats for respective listening positions at which to quiet unwanted noise. In various scenarios, the noise field can differ from a typical noise field within a passenger compartment of a vehicle, such as HVAC noise, or noise from adjacent rooms or spaces. Reference signals from these noise sources can be obtained using aforementioned sensor types, and secondary paths from noise cancelling speakers to error microphones can be characterized and stored. Further, in various scenarios, the positions of the listeners can vary over time, and the seat sensors or head tracking techniques described herein can be relied upon to determine the position of the head of the listener.

FIG. 2 is a sample schematic diagram of an RNC system 200, according to one or more aspects of the various embodiments. In FIG. 2, the RNC system 200 is scaled to include R accelerometer signals [X1(*n*), X2(*n*), . . . XR(n)] from accelerometers 204 and L speaker signals [Y1(*n*), Y2(*n*), . . . YL(n)] from speakers 210. Accordingly, the RNC system 200 can include R*L controllable filters (or W-filters) 226 between each of the accelerometer signals and each of the speakers. As an example, an RNC system having twelve accelerometer outputs (i.e., R=12) can employ six dual-axis accelerometers or four triaxial accelerometers. In the same example, a vehicle having six speakers (i.e., L=6) for reproducing anti-noise, therefore, can use seventy-two W-filters in total. At each of the L speakers, R W-filter outputs are summed to produce the anti-noise signal Y(n) of the speaker. Each of the L speakers can include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a speaker.

Figure 3:
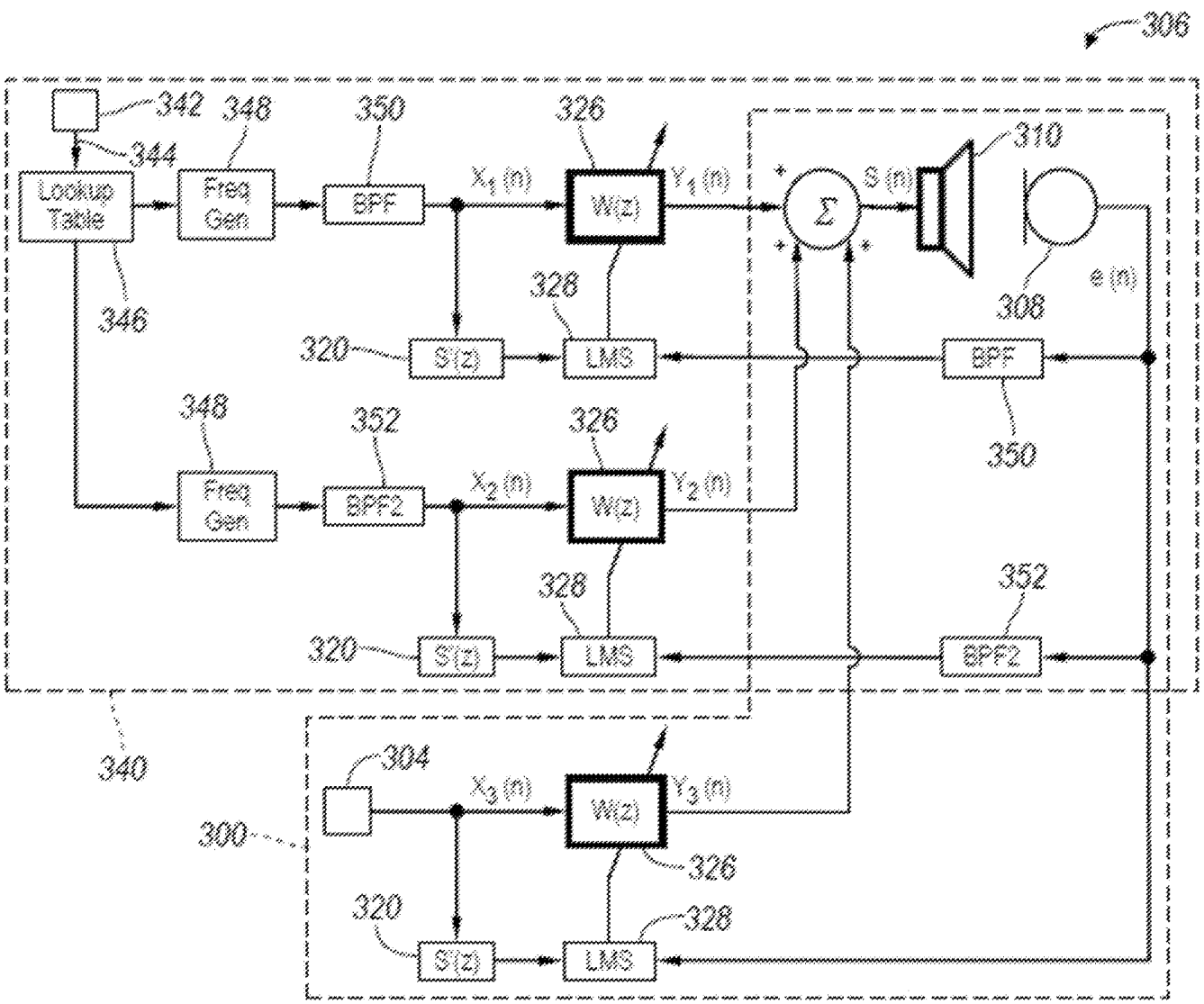
FIG. 3 is a sample schematic block diagram of an ANC system, according to one or more aspects of the various embodiments.

FIG. 3 is a schematic block diagram illustrating an example of an ANC system 306, including both an RNC system 300 and an EOC system 340. Similar to RNC system 106, the RNC system 300 can include a vibration sensor 304, physical microphone 308, W-filter 326, adaptive filter controller 328, secondary path filter 320, and speaker 310, consistent with operation of the vibration sensor 104, physical microphone 108, controllable W-filter 126, adaptive filter controller 128, secondary path filter 120, and speaker 110, respectively, discussed above.

The EOC system 340 includes an engine speed sensor 342, which provides an engine speed signal 344 (e.g., a square-wave signal) indicative of rotation of an engine crankshaft or other rotating shaft such as the drive shaft, half shafts or other shafts whose rotational rate is aligned with vibrations coupled to vehicle components that lead to noise in the passenger cabin. In some embodiments, the engine speed signal 344 can be obtained from a vehicle network bus (not shown). As the radiated engine orders are directly proportional to the crank shaft RPM, the engine speed signal 344 is representative of the frequencies produced by the engine and exhaust system. Thus, the signal from the engine speed sensor 342 can be used to generate reference engine order signals corresponding to each of the engine orders for the vehicle. Accordingly, the engine speed signal 344 can be used in conjunction with a lookup table 346 of Engine Speed (RPM) vs. Engine Order Frequency, which provides a list of engine orders radiated at each engine speed. The frequency generator 348 can take as an input the Engine Speed (RPM) and can generate a sine wave for each order based on this lookup table 346.

The frequency of a given engine order at the sensed Engine Speed (RPM), as retrieved from the lookup table 346, can be supplied to a frequency generator 348, thereby generating a sine wave at the given frequency. This sine wave represents a noise signal X(n) indicative of engine order noise for a given engine order. Similar to the RNC system 300, this noise signal X(n) from the frequency generator 348 can be sent to an adaptive controllable filter, or W-filter 326, which provides a corresponding anti-noise signal Y(n) to the speaker 310. In some embodiments, the RNC system can include multiple S'(z) filters (i.e., secondary path filters 120) and multiple W-filters 326 for respective subsystems. As shown, various components of this narrowband, EOC system 340 can be identical or similar to the broadband RNC system 300, including the physical microphone 308, adaptive filter controller 328 and secondary path filter 320. The anti-noise signal Y(n), broadcast by the speaker 310 generates anti-noise that is substantially out of phase but identical or similar in magnitude and frequency to the actual engine order noise at the location of an ear of a listener, which can be in close proximity to a physical microphone 308, thereby reducing the sound amplitude of the engine order. Because engine order noise is narrow band, the error signal e(n) can be filtered by a bandpass filter 350 prior to passing into the LMS-based adaptive filter controller 328. In an embodiment, proper operation of the LMS adaptive filter controller 328 is achieved when the error microphone signal e(n) is bandpass filtered using the same bandpass filter parameters.

In order to simultaneously reduce the amplitude of multiple engine orders, the EOC system 340 can include multiple frequency generators 348 for generating a noise signal X(n) for each engine order based on the engine speed signal 344 (e.g., measured in RPM). As an example, FIG. 3 shows a two order EOC system having two such frequency generators for generating a unique noise signal (e.g., X1(*n*), X2(*n*), etc.) for each engine order based on engine speed. Because the frequency of the two engine orders differ, the bandpass filters 350 and 352 (labeled BPF and BPF2, respectively) have different high- and low-pass filter corner frequencies. The number of frequency generators and corresponding noise-cancellation components will vary based on the number of engine orders to be cancelled for a particular engine of the vehicle. As the two-order EOC system 340 is combined with the RNC system 300 to form the ANC system 306, the anti-noise signals Y(n) output from the W-filters 326 are summed and sent to the speaker 310 as a speaker signal S(n). Similarly, the error signal e(n) from the physical microphone 308 can be sent to the three LMS adaptive filter controllers 328.

Noise cancellation performance degradation, noise gain, or actual instability can result if the modeled transfer characteristic S'(z), representing an estimate of the secondary path, that is stored in the ANC system 306 does not match the actual secondary path of the system. As previously discussed, the secondary path is the transfer function between an anti-noise generating speaker and a physical microphone. Accordingly, it essentially characterizes how the electrical anti-noise signal Y(n) becomes sound that is radiated from the speaker, travels through the car cabin to the physical microphone, and becomes part of the microphone output or error signal e(n) in the ANC system. The actual secondary path S(z) can deviate from the stored secondary path model S'(z), which is typically measured on a "golden system" by trained engineers, when a vehicle becomes substantially different from the reference vehicle or system in terms of geometry, passenger count, luggage loading, or the like.

ANC system 306 generates anti-noise that is ideally opposite in phase and identical in magnitude and frequency to the noise to be reduced at the ears of one or more listeners. Existing ANC systems often generate a zone of reduced noise ("quiet zone") that is centered around the physical microphone position(s). The size of the quiet zone is approximately one tenth of an acoustic wavelength, resulting in a quiet zone that decreases in size for increasing frequency. If only one physical microphone is used for a vehicle application, then there will be a steep gradient of performance as one moves their ear away from the microphone, especially once the ear is greater than one-tenth of a wavelength away. Further, for a system including one physical microphone, it is likely that the sound pressure level in some other locations of the vehicle will increase. To avoid this "noise boosting" at the location of a first or second vehicle listener, four or six physical microphones can be used so that the active system reduces the noise more uniformly throughout the cabin. In order to obtain the maximum perceived noise cancellation, the physical microphones would ideally be mounted at the ear locations of one or more listeners. However, in many practical cases, the physical microphones cannot be placed close to all ears of the passenger of the vehicle. This is due to vehicle packaging limitations, such as convertible tops, sunroofs, and the absence of seat mounted microphones, all of which can make it difficult to achieve maximum noise reduction where it matters the most, at the locations of the ears of the passenger of the vehicle.

Virtual Microphones

Referring back to FIG. 1, the vehicle 102 includes a physical microphone 108 that is located within a headliner. The physical microphone 108 is not located proximate to the ears of a listener sitting on the rear seat 125. However, the ANC system can include one or more virtual microphones that are located proximate to the ears of a listener sitting on the vehicle 102.

A virtual or remote microphone technique is a technique in which an ANC system estimates an error signal generated by an imaginary or virtual microphone at a remote location where no real physical microphone is located based on the error signals received from one or more real physical microphones. This virtual or remote microphone technique can improve noise cancellation at the locations of the ears of the passenger even when no physical microphone is actually located there. As used herein, noise cancellation includes noise reduction. An additional benefit is that this virtual microphone technique provides a flexible solution of physical microphone mounting locations. Compared with the conventional, non-virtual noise cancellation algorithm, the virtual microphone algorithm utilizes an estimated virtual signal as an error signal ev(n). Based on the virtual error signal estimate, the virtual microphone algorithm will adapt the W-filters 326 based on the estimated virtual error signal instead of the physical error signal. Hence, the noise cancellation system performance is maximized at the location of these virtual microphones, which are ideally close to the actual positions of the ears of the listener, rather than at the location of the physical microphones, which can be far from the ears of the listener, e, on the vehicle headliner. A vehicle with a headrest mounted microphone can benefit from the virtual microphone technique because a virtual microphone can be located closer to the ears of the listener than the headrest mounted microphone.

Figure 4:
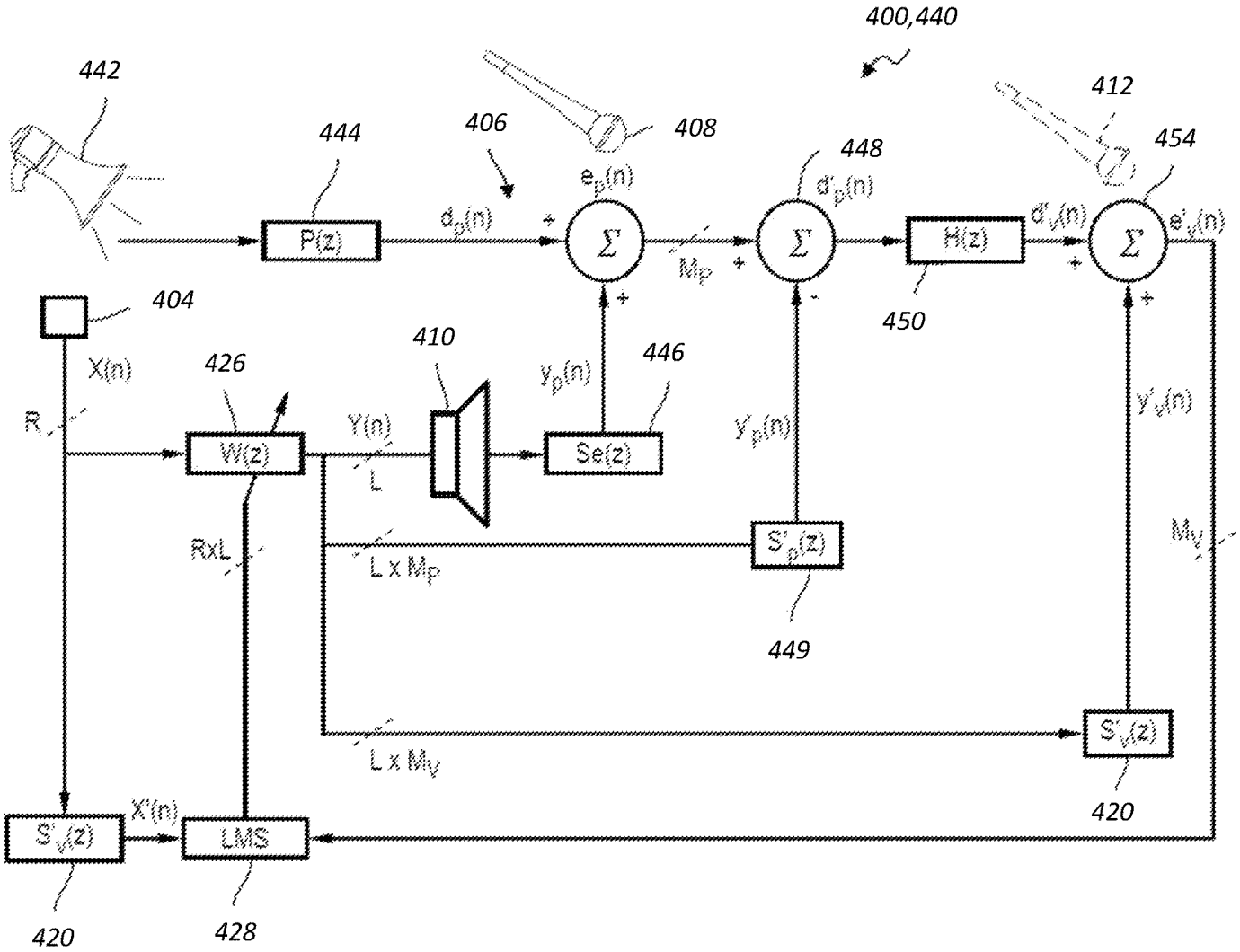
FIG. 4 is a schematic block diagram of a virtual microphone ANC system, according to one or more aspects of the various embodiments.

FIG. 4 is a schematic block diagram of a virtual or remote microphone (VM) ANC system 406, according to one or more various aspects of the various embodiments. For ease of explanation, the VM ANC system 406 illustrated in FIG. 4 is shown with components and features of an RNC system 400 and an EOC system 440. Accordingly, the VM ANC system 406 is a schematic representation of an RNC and/or EOC system, such as those described in connection with FIGS. 1-3, featuring additional system components of the VM ANC system 406 including a virtual microphone 412. Similar components can be numbered using a similar convention. For instance, similar to the ANC system of FIG. 1, the ANC system 406 can include a vibration sensor 404, a physical microphone 408, a controllable W-filter 426, an adaptive filter controller 428, a virtual secondary path filter 420, and an audio speaker 410, consistent with operation of the vibration sensor 104, the physical microphone 108, the controllable W-filter 126, the adaptive filter controller 128, the secondary path filter 120, and the speaker 110, respectively, discussed above. FIG. 4 also shows the primary path P(z) and secondary path S(z), as described with respect to FIG. 1, in block form for illustrative purposes.

The physical microphone 408 provides an error signal ep(n) that includes all the sound present at the location of the physical microphone 408, such as the disturbance signal dp(n) intended to be cancelled, which includes road noise, engine and exhaust noise, plus the anti-noise from the audio speaker 410, yp(n), and any extraneous sounds at the microphone location.

The virtual microphone 412 represents a microphone located at a virtual microphone location that would similarly sense all the sound at the virtual microphone location, such as the disturbance signal dv(n) to be cancelled, which includes road noise, engine, and exhaust noise, plus the anti-noise from the audio speaker 410 yv(n), and extraneous sounds. Typically, there are multiple physical microphone locations, and multiple virtual microphone locations. Note that during typical operation of the noise cancellation system, there is no actual microphone mounted at the location of the virtual microphone. So, with the virtual microphone technique, the pressure at the virtual microphone locations is estimated from the pressure at the physical microphone locations to form an estimated error signal e'v(n).

The physical microphone 408 senses both the noise dp(n) at the location of the physical microphone 408 from a noise source 442 after traveling along a primary path P(z) 444 and the anti-noise yp(n) at the location of the physical microphone 408 from the audio speaker 410 after traveling along a secondary path Se(z) 446. The physical microphone 408 provides a physical error signal ep(n). The VM ANC system 406 estimates the disturbance noise to be cancelled d'p(n) at the physical microphone location at block 448. The VM ANC system 406 subtracts an estimate of the anti-noise at the physical microphone location y'p(n) from the physical error signal ep(n) to estimate the disturbance noise at the physical microphone location d'p(n). The VM ANC system 406 then estimates the disturbance noise to be cancelled at the virtual microphone location d'v(n) at block 450 by convolving the estimated disturbance noise at the physical microphone location d'p(n) with the transfer function between the physical and virtual microphone location H(z) 450. At block 454, the VM ANC system 406 estimates the virtual microphone error signal e'v(n) that would be present at the virtual microphone location by adding the estimated disturbance noise to be cancelled at the virtual microphone location d'v(n) with an estimate of the anti-noise at this location y'v(n). This process thereby creates an estimate of the virtual error microphone signal from the physical error signal, the physical and virtual microphone secondary path and the transfer function between the physical and virtual locations.

Although the VM ANC system 406 is described with reference to a virtual microphone, other embodiments may include different types of ANC systems. For example, an ANC system can include a remote microphone (RM) to provide a RM ANC system.

A remote microphone differs from a virtual microphone in the value of the transfer function H(z). In certain literature, a VM ANC system 406 includes an H(z) 450 with a value of unity, or one, meaning that any difference in the disturbance signal to be cancelled between the physical and virtual locations is simply ignored. In certain literature, an RM ANC system includes a transfer function H(z) that is not equal to unity, meaning that there is a difference in the disturbance signal to be cancelled between the physical and virtual locations. However, various embodiments described herein using the term virtual microphone system or technique can be applied to the remote microphone system or technique, with the one alteration being the value of H(z).

Although FIGS. 1, 3, and 4 show LMS-based adaptive filter controllers 128, 328, and 428, respectively, various embodiments can include other methods and devices to adapt or create controllable W-filters 126, 326, and 426. For example and without limitation, in some embodiments, neural networks are employed to create and optimize W-filters in place of the LMS adaptive filter controllers. In some embodiments, machine learning or artificial intelligence may be used to create W-filters in place of the LMS adaptive filter controllers. Further, processing can be performed in either the time or frequency domain. That is, signal processing can occur in either the time domain, the frequency domain, or a combination thereof. Moreover, various processing steps can be performed through digital signal processing and/or analog signal processing.

Listener Head Movement Adaptations

Figure 5:
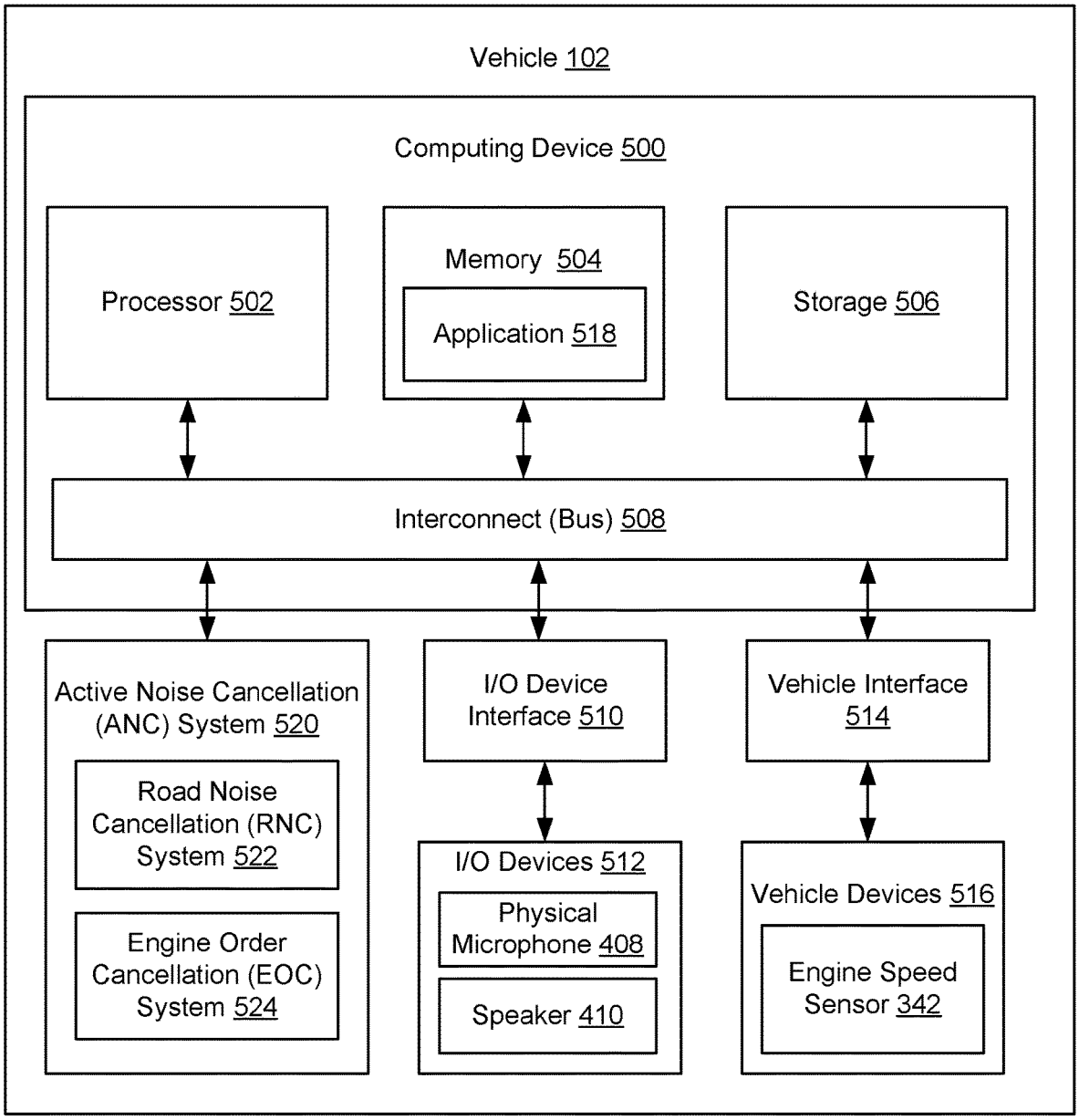
FIG. 5 illustrates a computing device, according to one or more aspects of the various embodiments.

FIG. 5 illustrates a computing device 500, according to one or more aspects of the various embodiments. For example, computing device 500 can be coupled with and/or integrated with an electronics system of a vehicle 102, such as part of a media system, and can be coupled with other components of the vehicle 102, such as an engine, tire, or telemetry system of the vehicle 102, either directly or through an interface bus such as a Controller Area Network (CAN) bus or via an OBD-II interface. It is noted that the computing device described herein is illustrative and that any other technically feasible configurations fall within the scope of the various embodiments.

As shown, computing device 500 includes, without limitation, an interconnect (bus) 508 that connects one or more processor(s) 502, memory 504, storage 506, an input/output (I/O) device interface 510 coupled to one or more input/output (I/O) devices 512, a vehicle interface 514 coupled to one or more vehicle device(s) 516, and an ANC system 520 including a road noise cancellation (RNC) system 522 and an engine order cancellation (EOC) system 524. Processor(s) 502 can be or can include any suitable processor, such as a central processing unit (CPU), a graphics processing unit (GPU), an application-specific integrated circuit (ASIC), a field programmable gate array (FPGA), a digital signal processor (DSP), and/or any other type of processing unit, or a combination of different processing units, such as a CPU configured to operate in conjunction with a GPU. In general, processor(s) 502 can be or can include any technically feasible hardware unit capable of processing data and/or executing software applications.

Figure 6:
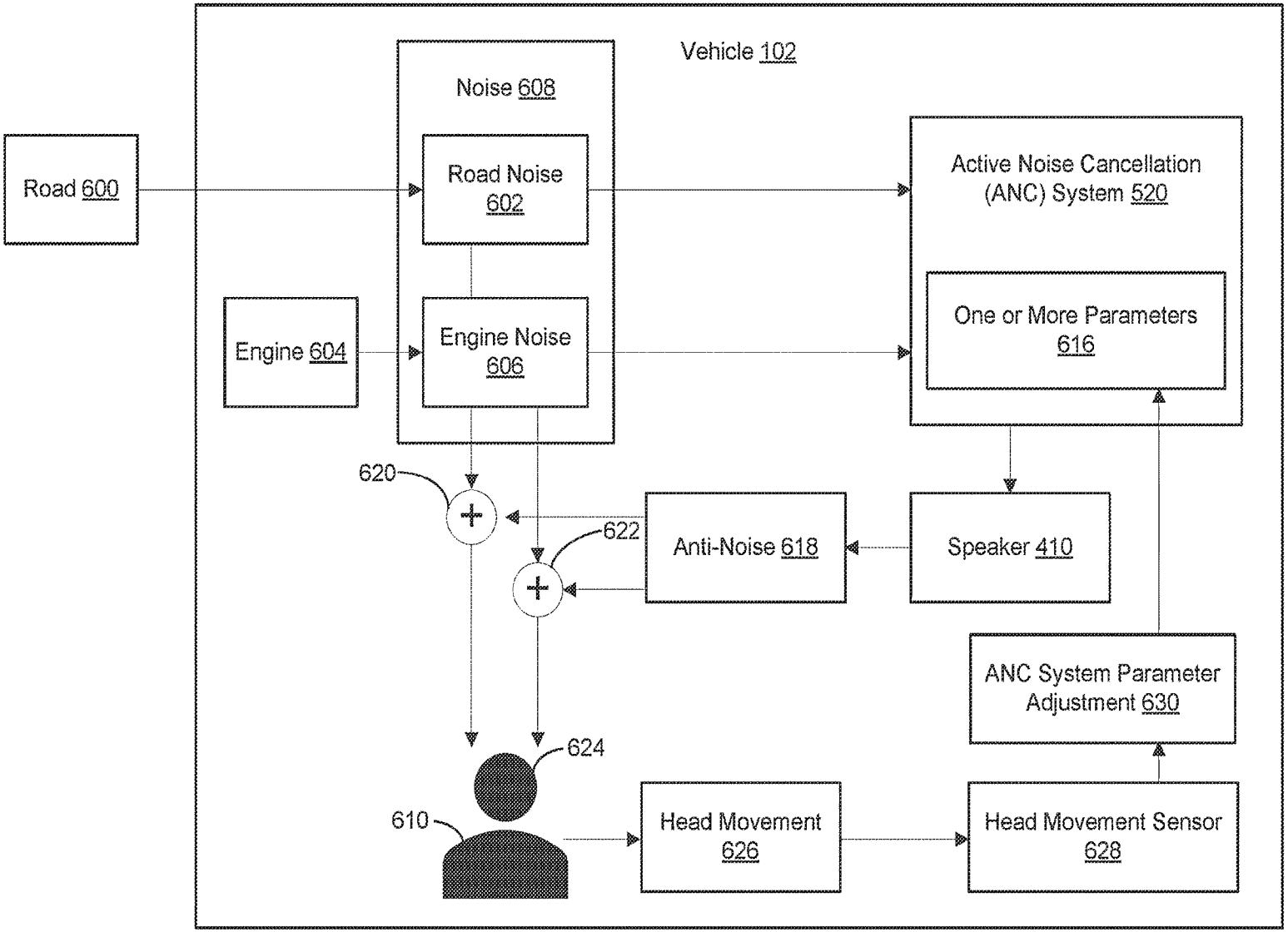
FIG. 6 is a block diagram illustrating an adjustment of one or more parameters of an active noise cancellation (ANC) system, according to one or more aspects of the various embodiments.

Memory 504 can be or can include a random-access memory (RAM) module, a flash memory unit, or any other type of memory unit or combination thereof. Processor(s) 502 and input/output (I/O) device interface 510 are configured to read data from and write data to memory 504. Memory 504 includes one or more applications 518 that adjust one or more parameters of an ANC system 520. For example, the one or more applications 518 can adjust one or more parameters of an RNC system 522, which can be the RNC system 300 of FIG. 3, and/or one or more parameters of an EOC system 524, which can be the EOC system 340 of FIG. 3. The processor 502 can be the processor 130 of FIG. 1. The ANC system 520 of FIG. 5 can be the ANC system 520 of FIG. 6. The one or more applications 518 can be included in the executed by processor(s) 502 and application data associated with the software programs, and/or may include the ANC system 520. As shown in FIG. 6, the one or more applications 518 of the computing device 500 and the ANC system can be different components; however, in some embodiments, the one or more applications 518 can include the ANC system 520.

Storage 506 can include non-volatile storage for applications and data and can include fixed or removable disk drives, flash memory devices, and CD-ROM, DVD-ROM, Blu-Ray, HD-DVD, or other magnetic, optical, or solid-state storage devices.

I/O devices 512 can be or can include devices capable of receiving input from an individual within a vehicle, such as microphones, buttons, or switches provided within a vehicle, as well as devices capable of providing output to an individual within the vehicle, such as display devices or speakers. In some embodiments, I/O devices 512 include an audio speaker 410 (and/or a similar audio output device, such as headphones) and/or a physical microphone 408, as well as display devices and/or one or more physical controls (e.g., one or more physical buttons, one or more touchscreen buttons, one or more physical rotary knobs, etc.) Additionally, I/O devices 512 can include devices capable of both receiving input and providing output, such as a touchscreen, a universal serial bus (USB) port, and so forth. I/O devices 512 can be configured to receive various types of input from a user of computing device 500, such as a listener within the vehicle 102 (e.g., receiving audio input, such as voice input, via physical microphone 408). I/O devices 512 can also provide various types of output to the end-user of computing device 500, such as displayed digital images or digital videos or text on display device and/or outputting audio via audio speaker 410. In some embodiments, one or more of I/O devices 512 are configured to couple a first computing device 500 to a second device (not shown). For example, I/O devices 512 can include a wireless and/or wired interface (e.g., a Bluetooth interface, a Universal Serial Bus interface) to/from another device (e.g., a smartphone).

Vehicle devices 516 can be or can include devices that provide functions related to the vehicle 102, such as vehicle control, vehicle system monitoring and telemetry, and/or interaction with individuals within the vehicle 102, such as in-dash driver assist systems and/or media consoles. As an example, the vehicle device 516 can be or can include an engine speed sensor 342 that determines an engine speed (e.g., an engine crankshaft rotational speed, measured in RPM). As an example, the vehicle device 516 can include one or more acceleration sensors. Vehicle device 516 can be integrated with other systems of the vehicle 102, coupled with other systems of the vehicle 102 (e.g., through a bus), and/or provided within the vehicle 102 in a manner that is decoupled from other systems of the vehicle 102. In some embodiments and as shown in FIG. 5, the vehicle device 516 can be coupled with the computing device 500 via a vehicle interface 514, such as an OBD-II interface, or Automotive Audio Bus (A2B), or Peripheral Sensor Interface 5 (PSI5) bus or via wires transmitting analog signals.

As previously discussed, active noise cancellation (ANC) system 520 can generate an anti-noise that cancels noise within the vehicle 102. In some embodiments and as shown in FIG. 5, the ANC system 520 includes an RNC system 522 (which can be or can include the RNC system 300 of FIG. 3) and an EOC system 524 (which can be or can include the EOC system 340 of FIG. 3). In some embodiments, the ANC system 520 includes only one of the RNC system 300 or the EOC system 340, and/or includes other noise cancellation components based on other techniques, including but not limited to feedback noise cancellation. As previously discussed, the ANC system 520 can determine a noise. The ANC system 520 can determine one or both of engine noise or road noise using physical microphone 408 of FIG. 3. The ANC system 520 can create an anti-noise such as sound that is substantially opposite in phase and identical or similar in magnitude and frequency to the noise. The ANC system 520 can output the anti-noise, e.g., using audio speakers 410, which can be dedicated speakers that only output the anti-noise, or can output a combination of the anti-noise and other sound, such as the audio output of a media center of the vehicle 102. The ANC system 520 can use the virtual or remote microphone technique shown in FIG. 4 to determine the noise at the position of a head of a listener within the vehicle 102 and/or to generate the anti-noise at the position of the head of the listener.

It is to be appreciated that FIG. 5 shows only one example of an embodiment, and that other embodiments can vary without departing from the scope of embodiments. As a first example, the computing device 500 shown in FIG. 5 includes one or more physical microphones 408 and an engine speed sensor 342, but some embodiments can omit the engine speed sensor 342. As a second example, the computing device 500 shown in FIG. 5 features an ANC system 520 including an RNC system 522 and an EOC system 524, but some embodiments can omit the RNC system 522 or can omit the EOC system 524. As a third example, the computing device 500 features a processor 502, a memory 504, a storage 506, a physical microphone 408, an audio speaker 410, an engine speed sensor 342, and an ANC system 520, but some embodiments can combine one or more such components; e.g., the processor 502 can be a component of the ANC system 520, and the physical microphone 408 and/or audio speaker 410 can be dedicated components of the ANC system 520 or can be shared between the ANC system 520 and other systems of the vehicle 102, such as a media system that combines an anti-noise with music, podcasts, directions, voice communication, or the like. Many such variations in the architecture shown in FIG. 5 can be included in the range of embodiments.

A first concern with some ANC systems is that the noise cancellation sensed by a listener is affected by the spatial variation in the noise field and the anti-noise field based on the disposition (e.g., position and/or orientation) of the head of a listener. For example, the anti-noise generated by the active noise cancellation system at a first position near the head of the listener can highly correspond to the noise at the first position, and can advantageously cancel the noise there. However, the noise and the anti-noise can correspond to a lesser degree at a second location near the head of the listener, which can reduce the effectiveness of noise cancellation and/or constructively interfere to create an increase in noise level at this second location. Thus, if the listener moves his or her head in position or orientation, possibly only by a small distance and/or rotates his or her head, the noise cancellation perceived by the listener can become less pronounced. In an extreme case, the noise cancellation may become noise amplification as compared with the original noise level. As another example, the noise and anti-noise at one ear of the listener can differ from the noise and anti-noise at the other ear of the listener, creating an imbalance in the resulting perceived noise. Further, the spatial variation in the noise field can be greater for the high-frequency portion of road or engine noise than for the mid-frequency and/or low-frequency portions of road or engine noise. The total noise at the location of two ear canal openings of the listener is the noise level that is perceived by the listener, and changes in the locations of the ear canal openings as the listener moves his or her head by rotation (in yaw, pitch and roll) and/or translation in three dimensional space change the total noise perceived by the listener.

For example, due to the non-uniformity of the noise and/or the anti-noise at various locations near the head of the listener, it is relevant to note that a difference in magnitude between the noise and the anti-noise of 4.5 dB (with a zero-degree phase mismatch) can result in noise cancellation of approximately 8 dB. A matching magnitude (a 0-dB mismatch) with a 24-degree phase mismatch of the noise and the anti-noise can also result in noise cancellation of approximately 8 dB. However, phase mismatches between the noise and the anti-noise of more than 24 degrees can result in less than 8 dB noise cancellation of the noise. A phase mismatch between the noise and the anti-noise exceeding 60 degrees can result in negative noise cancellation of the noise, which is termed noise boosting, which is undesirable. Magnitude mismatches higher than 4.5 dB can result in less than 8 dB noise cancellation. Noise cancellation in excess of 15 dB may occur with a magnitude deviation between the noise and the anti-noise that is less than 1 dB and a phase deviation between the noise and the anti-noise that is less than 10 degrees at a location.

As a result of the non-uniformity of the difference between the noise and the anti-noise at various locations near the head of the listener, movement of the head of a listener from side-to-side (or front-to-back) quickly over a distance of 10 to 20 cm, such as by head translation or rotation, can create odd sensations due to the noise cancellation changing as the ears of the listener through the non-uniform noise field and anti-noise field. Such odd sensations can occur due to a difference in the noise cancellation between the right ear of the listener and the left ear of the listener in the frequency range of 300-800 Hz. Further, the noise cancellation created by the anti-noise can differ at various locations to which the ears of the listener can be moved due to non-uniformity of both the road or engine noise field and the anti-noise field created by the local headrest speakers, or more distant speakers located on or near doors. In some cases, this can result in the listener experiencing 3 dB of noise cancellation at the right ear and 15 dB of noise cancellation at the left ear. In some cases, the listener may experience 5 dB or more of noise boosting in the 400-800 Hz frequency range in one ear and 10 dB of noise cancellation in the 400-800 Hz frequency range in the other ear.

One technique for addressing the first concern with some ANC systems (such as the ANC system 306 of FIG. 3 and/or the ANC system 406 of FIG. 4) is to determine the disposition of the head of the listener, and to generate the anti-noise based on the disposition (e.g., position and/or orientation) of the head of the listener. As previously discussed, in some variations, the anti-noise includes a combination of the anti-noise radiated from each of the speakers, which are driven by each of their individual Y signals. For example, a virtual microphone system, such as shown in FIG. 4, can adjust the position of the virtual microphone 412 to correspond to the disposition of the head of the listener (e.g., to a determined position of an ear of the listener), such that the anti-noise corresponds to and effectively cancels the noise at the locations of the ears corresponding to the disposition of the head of the listener. If the head of the listener moves, the ANC system can determine an updated disposition (e.g., position and/or orientation) of the head of the listener, update the position of the virtual microphone based on the updated disposition, and automatically re-determine the anti-noise signals Y to send to speakers to create anti-noise based on the updated position the ears of the listener. In this manner, the ANC system can adapt to changes in the disposition of the head of the listener to maintain the effectiveness of the active noise cancellation.

In some embodiments, the position of the virtual microphone 412 is adjusted to correspond to the disposition of the head of the listener, and specifically to the determined positions of the ears of the listener. The RNC or EOC system can pre-store more than one measured impulse response at more than one virtual microphone location. Further, to facilitate the remote microphone technique, a new H(z) 450 can be measured and stored for each virtual microphone location. As an example, ten virtual microphone locations can be respectively represented by impulse response and H(z) 450 characterized and stored for each of the right ear and left ear in the seat of a driver.

A second concern with some ANC systems is the slower than instantaneous rate at which the W-filters adapt, thereby creating a delay in creation of the ideal anti-noise signals Y, which are sent to speakers that radiate corresponding anti-noise to produce noise cancellation at the location of the ears of a listener. A delay in creating the corresponding anti-noise at the location of the ears of the listener limits the achievable noise cancellation. Delay can be caused, for example, by W-filter adaptation rate set by various tuning parameters including the step size and leakage, signal processing delays in using the reference signal or signals and W-filters to generate the anti-noise signal or signals, and/or acoustic propagation. In some embodiments, the adaptation rate of the W-filters can be selected to be slower than the maximum adaptation rate to aide in system stability to prevent the W-filters from diverging. For example, the maximum adaptation rate of a noise cancellation system can be reduced as the number of W-filters increases. In some scenarios, the number of W-filters scales as number of speakers and number of reference signals according to FIG. 2. The adaptation rate can be affected by bandwidth of the noise signal to be cancelled. That is, broadband RNC systems typically adapt much more slowly than narrowband EOC systems. Further, the speed of sound through air (343 m/s) between the speaker radiating anti-noise and the ears of the listener can be a source of delay in delivering anti-noise to the ears of the listener. Due to the shorter acoustic wavelengths of higher frequencies, a delay in delivering anti-noise to the ears of the listener creates a larger phase difference at higher frequency. In an example, the delay may make only a 10 degree difference at 40 Hz, but this is a 100 degree phase difference at 400 Hz. So, while the noise cancellation degradation at 40 Hz due to this delay may be negligible, a 100 degree phase difference is sufficient to create noise boosting instead of noise cancellation. As a result, the anti-noise can exhibit reduced effectiveness in canceling the noise, and can actually increase, rather than reduce, the noise within the vehicle 102.

Additional concerns about the adaptation rate of ANC systems in generating an anti-noise that corresponds to and effectively cancels the noise at the position of the ears of a listener can be exacerbated by a movement speed of the head of the listener. For example, a listener who rapidly and/or continuously moves his or her head, such as exaggerated nodding or shaking the head, can cause considerable delays and/or persistently reduced correspondence between the noise perceived by the listener and the anti-noise generated by the ANC system. As a result, the listener can perceive a prolonged and/or continuous reduction in the effectiveness of noise cancellation, and, possibly, amplified noise created by the anti-noise of the ANC system in addition to the noise. Further, such differences in correspondence between high-frequency components of the noise and anti-noise as the head of the listener moves can be larger than differences in correspondence between low-frequency components of the noise and anti-noise, as previously discussed. That is, the effectiveness of noise cancellation can be reduced to a greater degree for high frequencies than for low frequencies due to changes in the disposition of the head of the listener.

To address these concerns, in some embodiments, an ANC system (such as the ANC system 520 of FIG. 5) can have one or more parameters that can be adjusted based on a detected movement of a head of a listener. For example, when the head of the listener is substantially stationary, the ANC system can use a baseline set of parameters to generate the anti-noise that corresponds to the noise at the position of the head of the listener, based on the disposition (e.g., position and/or orientation) of the head of the listener. Based on a detection of a movement of the head of the listener (e.g., a speed of movement of the head of the listener), the ANC system can adjust one or more parameters by which the anti-noise is determined, such as the H(z) filter, the S'v(z), etc. For example, based on detecting a movement of the head of the listener, the ANC system can determine a cutoff frequency based on at least on the noise 608 and the movement of the head of the listener, and apply to the anti-noise generation a low-pass filter based on the cutoff frequency, wherein the ANC system does not produce frequencies of the anti-noise above the cutoff frequency, and/or produces attenuated anti-noise above the cutoff frequency. As previously discussed, the effectiveness of noise cancellation for high frequencies can be lower than for low frequencies due to changes in the disposition of the head of the listener. Thus, applying a low-pass filter based on a cutoff frequency to the anti-noise signals can maintain low frequency noise cancellation and/or reduce the noticeable noise boosting (or other unpleasant sensations) due to a mismatch between the noise and the anti-noise in a high-frequency band. Many such techniques for adapting the ANC system based on the movement of the head of the listener are disclosed herein and can be included in one or more embodiments. That is, when head movement occurs faster than the ANC system can account for or adapt, reducing anti-noise generation for selected frequencies can avoid noise boosting, imbalanced noise cancellation, degraded noise cancellation, unpleasant sensations, or the like.

FIG. 6 is a component block diagram illustrating an adjustment of one or more parameters 616 of an active noise cancellation (ANC) system 520, according to one or more aspects of the various embodiments. In various embodiments, techniques for adjusting one or more parameters 616 of the ANC system 520 can be included in and/or applied to the ANC noise cancellation systems shown in any of FIGS. 1-3, 4, and 5.

As shown in FIG. 6, a listener 610 within vehicle 102 can be exposed to a noise 608, which can include one or both of a road noise field 602 created by the interaction of the vehicles tires and the road 600 upon which the vehicle 102 is traveling, or an engine noise field 606 created by the engine 604 and/or exhaust system of the vehicle 102 (e.g., the engine orders produced by the engine 604 and exhaust system). The road noise field 602 and the engine noise field 606 are referred to collectively or alternatively as the noise 608.

As previously discussed, the effectiveness of noise cancellation can be limited by localized differences in the noise 608 and the anti-noise 618 at various dispositions of the head 624 of the listener 610. For example, movement 626 of a head 624 of the listener 610 from a first disposition, in which the anti-noise 618 highly corresponds to the noise 608 and the effectiveness of noise cancellation is substantial, to a second disposition, in which the anti-noise 618 does not highly correspond to the noise 608, can result in a reduced effectiveness of cancellation and/or amplification of the noise 608 by the anti-noise 618 at the position of the head 624 of the listener 610.

To address these limitations, in some embodiments, the vehicle 102 can further include a head movement sensor 628 that detects a movement of a head 624 of the listener 610. As a first example, the head movement sensor 628 can be or can include one or more cameras that determine the movement of the head 624 of the listener 610 based on images of the head 624 of the listener 610, for example, by comparing consecutive video frames and determining an occurrence and/or measurement of the movement of the head 624 of the listener 610 during the interval between the video frames. In some embodiments, a stereo pair of visible light or IR cameras detect and/or measure the movement of the head 624 of the listener 610. As a second example, the head movement sensor 628 can be or can include one or more proximity sensors (e.g., infrared proximity sensors) that determine the movement 626 of the head 624 of the listener 610 based on a proximity of the head 624 of the listener 610 to the one or more proximity sensors (e.g., based on detecting a change in the proximity of the head 624 to the one or more proximity sensors over a time interval). As a third example, the head movement sensor 628 can be or can include one or more LIDAR sensors that determine the movement 626 of the head 624 of the listener 610 based on a LIDAR field (e.g., a change in a localized LIDAR point cloud determined for a vicinity of the head 624 of the listener 610 over at time interval). Further, the movement 626 of the head 624 of the listener 610 can be determined by a variety of physical properties relating to the disposition of the head 624 of the listener 610. Some embodiments include short-range or medium-range radar or time-of-flight sensor that detects the movement 626 of the head 624 of the listener 610.

In some embodiments, the detection of the movement 626 of the head 624 of the listener 610 and/or the adjustment of one or more parameters 616 of the ANC system 520 can be performed by one or more applications 518 of a computing device 500 and/or by one or more hardware processors (such as a field-programmable gate array and/or one or more combinations of discrete circuit components). The adjustments of the one or more parameters 616 of the ANC system 520 by the application 518, by a hardware processor, and/or by discrete circuit components can be or can include, at least, one or more of the following examples.

In some embodiments, the adjustment 630 of the one or more parameters 616 the ANC system 520 can be based on a variety of physical properties of the movement 626 of the head 624 of the listener 610. Such physical properties can include, e.g., one or more of: a position change of the head 624 of the listener 610; a speed of a position change of the head 624 of the listener 610; and/or an acceleration of a position change of the head 624 of the listener 610; or the like. The physical properties can include, e.g., one or more of: an orientation (e.g. rotation) change of the head 624 of the listener 610; a speed of an orientation change of the head 624 of the listener 610; and/or an acceleration of an orientation change of the head 624 of the listener 610. In particular, because certain orientation changes (e.g., nodding, shaking, or turning the head 624) can occur more rapidly than translation changes (e.g., moving the head 624 to a different height and/or between fore-aft and lateral positions) and can result in greater variation between the noise 608 and the anti-noise 618, some embodiments can use one or more orientation-type sensors for the head movement sensor 628. In some embodiments, the adjustment can be based on the movement 626 of the head 624 of the listener 610 exceeding one or more movement thresholds, such as a displacement range, speed, and/or acceleration of the movement 626 of the head 624 of the listener 610. In some embodiments, the adjustment 630 is based on a position change of the ear canal openings of the head 624 of the listener 610.

In various embodiments, the one or more parameters 616 of the ANC system 520 can be adjusted in a variety of ways based on the detected movement 626 of the head 624 of the listener 610. For example, in some embodiments, the adjustment 630 of the one or more parameters 616 can be based at least on the movement 626 of the head 624 of the listener 610 exceeding a movement threshold. For example, if the speed of movement 626 of the head 624 of the listener 610 exceeds a speed threshold, the ANC system 520 can refrain from generating the anti-noise 618, until and unless the speed of movement 626 of the head 624 of the listener 610 is reduced below the speed threshold. In another example, if the speed of movement 626 of the head 624 of the listener 610 exceeds a speed threshold, the ANC system 520 can generate anti-noise 618 at an attenuated level, until the speed of movement 626 of the head 624 of the listener 610 is reduced below the speed threshold. Alternatively, the adjustment 630 can include applying a low-pass filter based on a cutoff frequency, that is, a frequency above which the ANC system 520 does not produce frequencies of the anti-noise 618 and/or attenuates an upper-frequency band of the anti-noise 618 (e.g., reducing and/or incrementally tapering frequencies of the anti-noise 618 above a cutoff frequency). Various embodiments can include various methods of applying a high pass filter (HPF) to the anti-noise, such as (without limitation) applying a HPF to the speaker anti-noise signal Y, applying an HPF to the W-filter 326, applying an HPF to the accelerometer signal, and/or modifying a lookup table 346 or frequency generator 348 in the case of an EOC system. In some embodiments, anti-noise above a threshold frequency is reduced or eliminated by sending anti-noise signal Y only to speakers 310 that do not play sound with high efficiency above the threshold frequency, and/or that do not radiate sound above the threshold frequency with high efficiency to the location of the head 624 of the listener 610.

In some embodiments, the adjustment 630 of the one or more parameters 616 can be or can include adjusting the one or more parameters 616 based at least on the movement 626 of the head 624 of the listener 610 exceeding a first movement threshold, and further adjusting the one or more parameters 616 based at least on the movement 626 of the head 624 of the listener 610 exceeding a second movement threshold that is higher than the first movement threshold. For example, a first upper-frequency threshold can be applied to the anti-noise 618 based on a detected speed of the movement 626 of the head 624 of the listener 610 exceeding a first speed (e.g., generating the anti-noise 618 with frequencies limited to below 400 Hz, such as by deactivating a first anti-noise generator of the ANC system 520 that generates a first anti-noise frequency, such as a W-filter for a 400 Hz frequency of the anti-noise 618). Further, a second upper-frequency threshold, lower than the first upper-frequency threshold, can be applied to the anti-noise 618 based on a detected speed of the movement 626 of the head 624 of the listener 610 exceeding a second speed (e.g., generating the anti-noise 618 with frequencies limited to below 300 Hz, such as by deactivating or attenuating a first anti-noise generator of the ANC system 520 that generates a first anti-noise frequency, such as a W-filter for a 300 Hz frequency of the anti-noise 618). As another example, the one or more parameters 616 can be adjusted in proportion with the movement displacement, speed, and/or acceleration of the head 624 of the listener 610 (e.g., adjusting an upper-frequency threshold or high pass filter corner frequency of the anti-noise 618 to be inversely proportional to a displacement, speed, and/or acceleration of movement 626 of the head 624 of the listener 610). Some embodiments can include a plurality of thresholds (e.g., three or more thresholds). Some embodiments determine a threshold based on a displacement of the head 624 or the ear or ears of the listener 610 relative to an adjacent object, such as an audio speaker 410. For example and without limitation, when the ear of a listener is further than 30 cm from an audio speaker 410 positioned on the seat or headrest, an upper frequency threshold is reduced to create anti-noise only below 300 Hz in effort to reduce the effect of increased delay on the anti-noise at the ears of the head 624 of the listener 610. When the ear of a listener is closer than 10 cm from an audio speaker 410 positioned on the seat or headrest, an upper frequency threshold is reduced to create anti-noise only below 300 Hz in effort to reduce the effect of the increased spatial variation of anti-noise proximal to the speaker that is sensed at the ears of the head 624 of the listener 610.

In some embodiments, the adjustment 630 of the one or more parameters 616 can be or can include adjusting a first parameter of the one or more parameters 616 of a road noise cancellation feature of the anti-noise 618 based at least on the movement 626 of the head 624 of the listener 610, and adjusting a second parameter of the one or more parameters 616 of an engine noise cancellation feature of the anti-noise 618 based at least on the movement 626 of the head 624 of the listener 610. That is, the ANC system 520 can adjust the one or more parameters 616 of an RNC system (such as RNC system 300) in a different manner than one or more parameters 616 of an EOC system (such as EOC system 340). For example, a movement speed of the head 624 of the listener 610 within a first speed threshold can cause the ANC system 520 to generate the anti-noise 618 including both road noise cancellation components generated by an RNC system and engine order cancellation components generated by an EOC system. A movement speed of the head 624 of the listener 610 exceeding the first movement threshold and within a second movement threshold can cause the ANC system 520 to generate the anti-noise 618 including only the engine order cancellation components generated by the EOC system, and to refrain from generating a road noise cancellation component of the anti-noise 618 (e.g., due to the lower frequencies of the engine order cancellation components than the road noise cancellation components). A movement speed of the head 624 of the listener 610 exceeding the second speed threshold can cause the ANC system 520 to further refrain from generating an engine noise cancellation component of the anti-noise (i.e., to refrain from generating the anti-noise 618).

In some embodiments, the adjustment 630 of the one or more parameters 616 can be or can include determining an occurrence frequency of the movement 626 of the head 624 of the listener 610, and adjusting the one or more parameters 616 based at least on the occurrence frequency. For example, if the listener 610 is determined to perform movements 626 of the head 624 frequently and/or exceeding a movement threshold such as speed, the ANC system 520 can refrain from generating the anti-noise 618 in a frequency range, or can attenuate and/or apply or lower a cutoff frequency of a low-pass filter applied to the anti-noise 618. In various embodiments, a low pass filter is applied to the anti-noise in various ways, including (without limitation) filtering the reference signals (accelerometer and/or frequency generator), filtering the W-filters, directly filtering the anti-noise Y signals, or the like. In an EOC system, the values in the Lookup Table 346 can be modified such that anti-noise is not created above a frequency threshold. If the listener 610 is determined to perform movements 626 infrequently and/or only within a movement threshold such as speed, the ANC system 520 can generate the anti-noise 618 or can reduce an attenuation and/or withdraw or raise an upper frequency limit, of the anti-noise 618.

In some embodiments, the adjustment 630 of the one or more parameters 616 can be based at least on an adaptation rate of the ANC system 520. For example, the ANC system 520 of FIG. 6 can be capable of responding to movements 626 of the head 624 of the listener 610 at a maximum rate. The maximum rate is due to the limited computational resources of the ANC system 520, the bandwidth of the noise cancellation system, the number of W-filters 326 or reference signals, and/or the difference between the virtual microphone 412 and physical microphone 408. A trained tuning engineer can predetermine, or the ANC system 520 can measure and store the adaptation rate (e.g., a maximum rate of change in the movement 626 of the head 624 of the listener 610 for which an RNC system and/or EOC system can stably and accurately produce the anti-noise 618). Based on determining a higher adaptation rate, the ANC system 520 can adjust the one or more parameters 616 to generate the anti-noise 618 in an expansive manner (e.g., canceling a wider and/or higher range of frequencies of the noise 608). Based on determining a lower adaptation rate, the ANC system 520 can adjust the one or more parameters 616 to generate the anti-noise 618 in a conservative manner (e.g., canceling a narrower and/or lower range of frequencies of the noise 608). Alternatively, in some embodiments, the adaptation rate can be predetermined and stored.

In some embodiments, the adjustment 630 of the one or more parameters 616 can be based at least on a preference of the listener 610. For example, the listener 610 can select an attenuation level of the anti-noise 618; a sensitivity of the head movement sensor 628 in detecting the head movement 626 of the listener 610; and/or a scaling factor by which an upper-frequency band of the anti-noise 618 is proportionally attenuated.

In some embodiments, the disclosed techniques can be applied on behalf of two or more listeners 610. For example, a first set of components can be positioned in relation to a first listener 610 (e.g., a first microphone and a first speaker for a driver in a driver seat of a vehicle). and a second set of components can be positioned in relation to a second listener 610 (e.g., a first microphone and a first speaker for a passenger in a passenger seat of a vehicle). According to the techniques presented herein, a first anti-noise can be generated for the first listener 610 through the first set of speakers based on movement of the head of the first listener 610, and a second anti-noise can be generated for the second listener 610 based on movement of the head of the second listener 610. In some embodiments, one or more components can be used to generate the anti-noise for multiple listeners 610 (e.g., using one accelerometer to create an anti-noise signal for a first and second listener or using one camera to detect movement of the head of the first listener 610 and movement of the head of the second listener 610).

In some embodiments, the adjustment 630 of the one or more parameters 616 can be or can include adjusting one or more parameters 616 of a feedback noise cancellation system based at least on the movement 626 of the head 624 of the listener 610. A feedback noise cancellation system is capable of canceling, or reducing in level either or both road noise or engine noise. Feedback cancellation systems employ a microphone 408 positioned typically in close proximity to an anti-noise speaker in addition to a feedback filter to shape the anti-noise 618. The gain or shape of the feedback filter can be altered in response to the location or movement 626 of the head 624 of the listener 610, in order to attenuate the highest frequencies of anti-noise created by the feedback noise cancellation system, and/or other aforementioned reasons.

Figure 7:
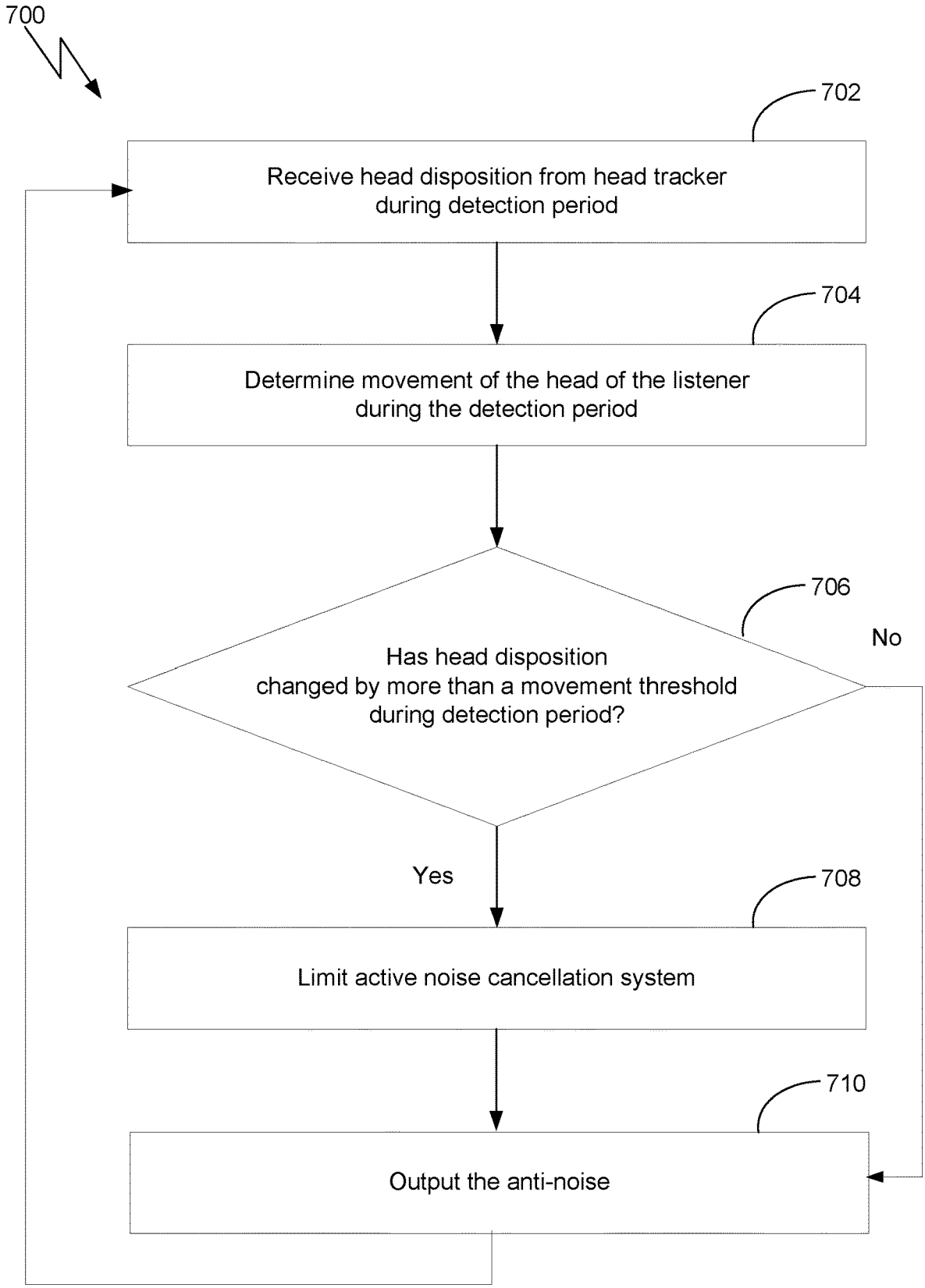
FIG. 7 illustrates a flow diagram of method steps for controlling an active noise cancellation (ANC) system, according to one or more aspects of the various embodiments.

FIG. 7 illustrates a first flow diagram of method steps for controlling an active noise cancellation (ANC) system, according to one or more aspects of the various embodiments. The method steps of FIG. 7 can be applied, e.g., by the computing device 500 of FIG. 5 and/or the example embodiment of FIG. 6. Although the method steps of FIG. 7 are described with respect to the systems of FIGS. 5 and 6, many systems configured to perform the method steps, in any order, can fall within the scope of the various embodiments.

As shown, a method 700 begins at step 702 in which a head disposition is received from a head tracker during a detection period. In some embodiments, a head tracker including one or more cameras, proximity sensor such as an infrared proximity sensor, a time-of-flight sensor, and/or a LIDAR or RADAR detector can determine the head disposition at various time points of the detection period, such as a center, middle, boundary, distance, elevation, lateral position, coordinate, an angle of a yaw, pitch, roll, or tilt rotational axis, ear (pinna) position, ear canal opening position, or the like.

At step 704, movement 626 of the head 624 of the listener 610 during the detection period is determined. In some embodiments, the head tracker can compare the determined head disposition and/or at successive time points, and/or during an interval in order to determine, and optionally measure, the movement 626 of the head 624 (e.g., a linear or angular displacement distance, speed, acceleration, or the like). In some embodiments, the movement 626 is detected and/or determined as a relative distance between the head 624 and another object or location.

At step 706, a determination can be made as to whether head disposition has changed by more than a movement threshold during the detection period. For example, the displacement distance, rotation angle, speed, acceleration, or the like can be compared with a threshold displacement distance, threshold speed, threshold acceleration, or the like. If the head disposition has not changed by more than the movement threshold, the method can continue to step 710.

At step 708, based on determining that the head disposition has changed by more than the movement threshold during the detection period, an ANC system 520 can be limited. For example, the generation of the anti-noise 618 can be disabled, attenuated, or an upper frequency band of the anti-noise 618 can be limited and/or attenuated by a low-pass filter or the like, based on a cutoff frequency for example.

At step 710, the ANC system outputs the anti-noise 618. For example, the anti-noise 618 can be provided to audio speakers 410 of the vehicle 102 of FIG. 5 for output. In some embodiments, the audio speakers 410 can be dedicated audio speakers of the ANC system 520 or shared audio speakers that combine the anti-noise 618 with audio from a media center of the vehicle 102. The method 700 can then return to step 702.

Figure 8:
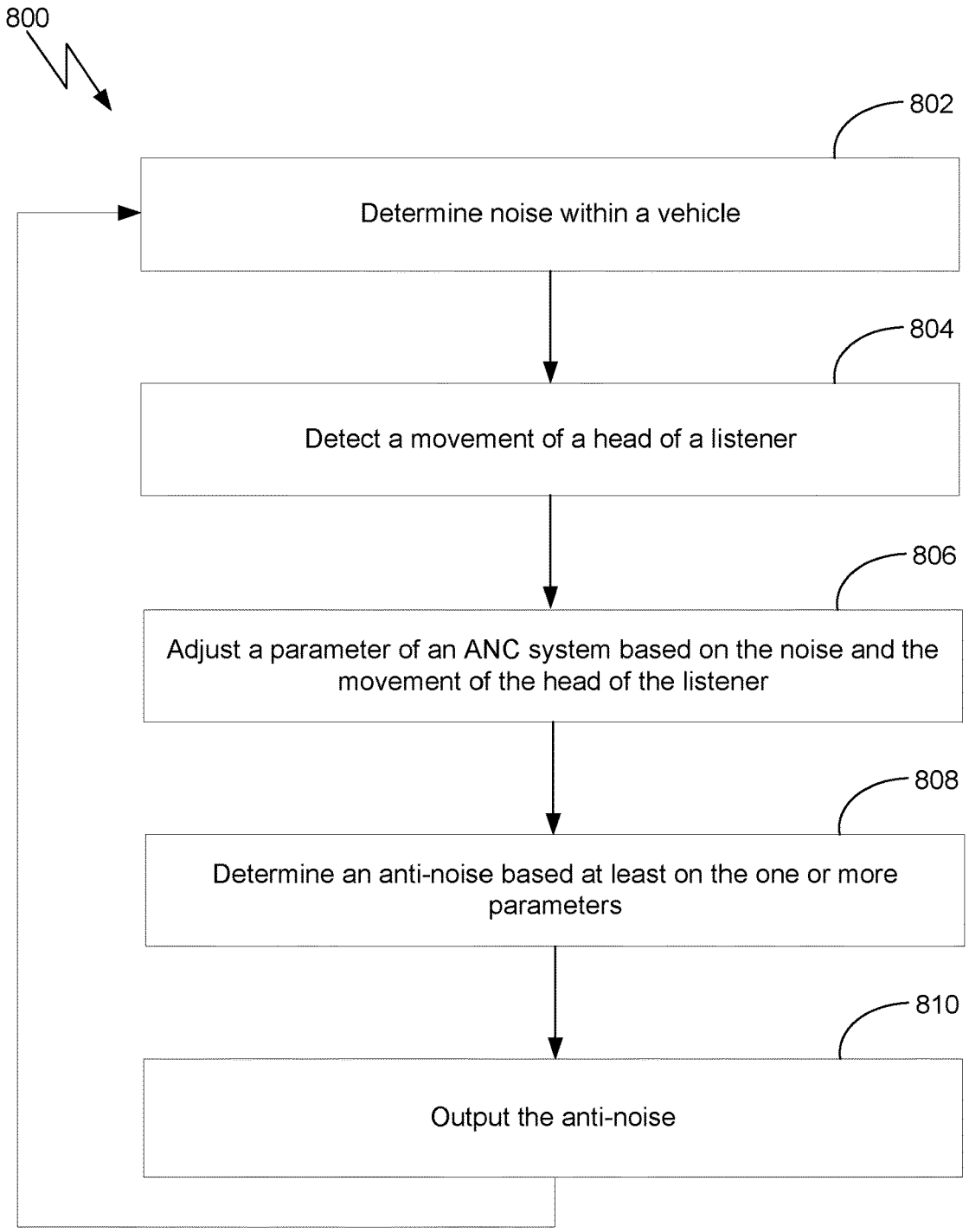
FIG. 8 illustrates a flow diagram of method steps for controlling an active noise cancellation (ANC) system, according to one or more aspects of the various embodiments.

FIG. 8 illustrates a second flow diagram of method steps for controlling an active noise cancellation (ANC) system, according to one or more aspects of the various embodiments. The method steps of FIG. 8 can be applied, e.g., by the computing device 500 of FIG. 5 and/or the example embodiment of FIG. 6. Although the method steps of FIG. 8 are described with respect to the systems of FIGS. 5 and 6, many systems configured to perform the method steps, in any order, can fall within the scope of the various embodiments.

As shown, a method 800 begins at step 802, in which a noise 608 within a vehicle 102 is determined. For example, an RNC system 300 can determine a road noise field 602 (e.g., using one or more microphones), and/or an engine noise field 606. (e.g., using one or more microphones)

At step 804, a movement of a head of a listener is detected. For example, a head movement sensor 628 (e.g., one or more cameras, a proximity sensor such as an infrared proximity sensor, a time-of-flight sensor, and/or a LIDAR or RADAR sensor) can determine a disposition of the head 624 of the listener 610 during an interval, and can determine the movement 626 of the head 624 of the listener 610 based on a comparison of the detected disposition during the interval, such as shown in the method of FIG. 7.

At step 806, one or more parameters 616 of the ANC system 520 are adjusted based at least on the noise 608 and the movement 626 of the head 624 of the listener 610, such as shown in the example method of FIG. 7. For example, based on the movement 626 of the head 624 of the listener 610 exceeding a movement threshold, an upper-frequency threshold can be selected to limit the frequencies of the anti-noise 618 generated by the ANC system 520. Alternatively or additionally, an upper-frequency band of the anti-noise 618 can be identified that is to be attenuated (e.g., reduced and/or incrementally tapered) by the ANC system 520, and the ANC system can refrain from generating the anti-noise 618 or one or more components thereof.

At step 808, an anti-noise 618 is determined based at least on the adjusted one or more parameters 616. For example, a low-pass filter can be applied to the anti-noise 618 generated by the ANC system 520 to attenuate and/or exclude high frequencies according to a low-pass filter based on a cutoff frequency. Alternatively or additionally, the ANC system 520 can refrain from generating the anti-noise 618 or one or more components thereof while the movement 626 of the head 624 of the listener 610 exceeds a movement threshold. Alternatively or additionally, the ANC system 520 can generate at an attenuated level the anti-noise 618 or one or more components thereof while the movement 626 of the head 624 of the listener 610 exceeds a movement threshold.

At step 810, the anti-noise 618 is output. For example, the anti-noise 618 can be provided to audio speakers 410 of the vehicle 102 of FIG. 5 for output. In some embodiments, the audio speakers 410 can be dedicated audio speakers of the ANC system 520 or shared audio speakers that combine the anti-noise 618 with audio from a media center of the vehicle 102. The method 800 can then return to step 802.

In sum, techniques for controlling an active noise cancellation (ANC) system can adapt the anti-noise based on movement of the head of the listener. The techniques can include determining a noise within a vehicle, which can include a road noise field of road noise within the vehicle and/or an engine noise field of an engine noise within the vehicle. Movement of a head of a listener can be detected, for example, by detecting one or more of a position change of the head of the listener, a speed of a position change of the head of the listener, an acceleration of a position change of the head of the listener, an orientation change of the head of the listener, a speed of an orientation change of the head of the listener, or an acceleration of an orientation change of the head of the listener. One or more parameters of the ANC system can be adjusted based at least on the noise and the movement of the head of the listener, such as attenuating the anti-noise based on a movement of the head of the listener exceeding a movement threshold, and/or by applying a high-end cutoff frequency above which the ANC system does not produce frequencies of the anti-noise. The techniques can include determining an anti-noise based on the at least one or more parameters, such as determining an audio output of one or more speakers of the vehicle that, at a location of at least a portion of the head of the listener, is of similar magnitude and opposite phase to a noise at the location of the at least a portion of the head of the listener. Outputting the anti-noise, e.g., by the one or more speakers of the vehicle, can produce sound corresponding to the anti-noise that is responsive to the movement of the head of the listener so that the anti-noise is more likely to correspond to and reduce the noise.

At least one technical advantage of the disclosed techniques relative to the prior art is that, with the disclosed techniques, an ANC system can reduce the anti-noise during periods in which a mismatch between the noise and the anti-noise at the location of the head of the listener is likely to occur, e.g., because the accuracy of a determination of the noise and/or anti-noise at the position of the head of the listener (such as by virtual microphone technique) can be reduced based on the movement of the head of the listener, and/or because the ANC system is unable to adapt quickly enough to a movement of the head of the listener to adjust the anti-noise to cancel the noise at the new position of the head of the listener. That is, the ANC system can reduce the anti-noise during periods in which destructive interference between the noise and the generated anti-noise is likely to be reduced, and/or during which constructive interference between the noise and the generated anti-noise is likely to occur. The ANC system can therefore reduce a period during which the anti-noise would undesirably increase a noise level, which can be uncomfortable, districting, or even dangerous to the listener. These technical advantages provide one or more technological improvements over prior art approaches.

1. In some embodiments, a computer-implemented method of controlling an active noise cancellation (ANC) system includes determining a noise within a vehicle, detecting a movement of a head of a listener, adjusting one or more parameters of the ANC system based at least on the noise and the movement of the head of the listener, determining an anti-noise based at least on the adjusted one or more parameters, and outputting the anti-noise.

2. The computer-implemented method of clause 1, wherein determining the noise within the vehicle includes detecting one or more of, a road noise field of road noise within the vehicle, or an engine noise field of an engine noise within the vehicle.

3. The computer-implemented method of clauses 1 or 2, wherein detecting the movement of the head of the listener includes detecting one or more of, a position change of the head of the listener, a speed of a position change of the head of the listener, an acceleration of a position change of the head of the listener, an orientation change of the head of the listener, a speed of an orientation change of the head of the listener, or an acceleration of an orientation change of the head of the listener.

4. The computer-implemented method of any of clauses 1-3, wherein adjusting the one or more parameters includes refraining from generating the anti-noise in a frequency range based at least on the movement of the head of the listener exceeding a movement threshold.

5. The computer-implemented method of any of clauses 1-4, wherein adjusting the one or more parameters comprises determining a cutoff frequency based on at least on the noise and the movement of the head of the listener, and applying, to the anti-noise, a low-pass filter based on the cutoff frequency.

6. The computer-implemented method of any of clauses 1-5, wherein adjusting the one or more parameters includes, adjusting a first parameter of the one or more parameters of a road noise cancellation feature of the anti-noise based at least on the movement of the head of the listener, and adjusting a second parameter of the one or more parameters of an engine noise cancellation feature of the anti-noise based at least on the movement of the head of the listener.

7. The computer-implemented method of any of clauses 1-6, wherein adjusting the one or more parameters includes, refraining from generating a road noise cancellation component the anti-noise based at least on the movement of the head of the listener exceeding a first movement threshold, and refraining from generating an engine noise cancellation component the anti-noise based at least on the movement of the head of the listener exceeding a second movement threshold that is higher than the first movement threshold.

8. The computer-implemented method of any of clauses 1-7, wherein adjusting the one or more parameters includes, determining an occurrence frequency of the movement of the head of the listener, and further adjusting the one or more parameters based at least on the occurrence frequency.

9. In some embodiments, a non-transitory computer readable medium stores instructions that, when executed by a processor, cause the processor to perform the steps of determining a noise within a vehicle, detecting a movement of a head of a listener, based at least on the noise and the movement of the head of the listener, adjusting one or more parameters of an active noise cancellation (ANC) system, determining an anti-noise based at least on the adjusted one or more parameters, and outputting the anti-noise.

10. The non-transitory computer readable medium of clause 9, wherein adjusting the one or more parameters includes adjusting the one or more parameters based at least on an adaptation rate of the ANC system.

11. The non-transitory computer readable medium of either of clauses 9 or 10, wherein adjusting the one or more parameters includes, deactivating a first anti-noise generator of the ANC system that generates a first anti-noise frequency based at least on the movement of the head of the listener exceeding a first movement threshold, and deactivating a first anti-noise generator of the ANC system that generates a second anti-noise frequency based at least on the movement of the head of the listener exceeding a second movement threshold, the second anti-noise frequency being lower than the first anti-noise frequency.

12. The non-transitory computer readable medium of any of clauses 9-11, wherein adjusting the one or more parameters includes adjusting the one or more parameters in proportion with the movement of the head of the listener.

13. The non-transitory computer readable medium of any of clauses 9-12, wherein adjusting the one or more parameters includes refraining from generating frequencies of the anti-noise above a cutoff frequency based at least on the movement of the head of the listener.

14. The non-transitory computer readable medium of any of clauses 9-13, wherein adjusting the one or more parameters includes attenuating an upper-frequency band of the anti-noise based at least on the movement of the head of the listener exceeding a movement threshold.

15. The non-transitory computer readable medium of any of clauses 9-14, wherein adjusting the one or more parameters includes adjusting the one or more parameters based at least on a preference of the listener.

16. The non-transitory computer readable medium of any of clauses 9-15, wherein adjusting the one or more parameters includes adjusting a noise input of the ANC system by adjusting one or both of, one or more noise sensors that determine the noise within the vehicle, or a noise input to an anti-noise generator of the ANC system that determines the anti-noise.

17. The non-transitory computer readable medium of any of clauses 9-16, wherein adjusting the one or more parameters includes adjusting an anti-noise output of the ANC system by adjusting one or both of, an anti-noise output of an anti-noise generator of the ANC system that determines the anti-noise, or an anti-noise output of the ANC system that outputs the anti-noise.

18. In some embodiments, an active noise cancellation (ANC) system comprises one or more noise sensors that determine a noise within a vehicle, one or more movement sensors that detect a movement of a head of a listener, one or more anti-noise generators that, based at least on the noise and the movement of the head of the listener, adjust one or more parameters of the ANC system, and determine an anti-noise based at least on the adjusted one or more parameters, and one or more anti-noise outputs that output the anti-noise.

19. The ANC system of clause 18, wherein the one or more noise sensors include one or both of, one or more microphones that determine the noise based on audio input, or one or more vehicle sensors that each map one or more vehicle metrics to a determination of at least a part of the noise or the anti-noise.

20. The ANC system of either of clauses 18 or 19, wherein the one or more movement sensors include one or more of, one or more camera that determine the movement of the head of the listener based on images of the head of the listener, one or more proximity sensors that determine the movement of the head of the listener based on a proximity of the head of the listener to the one or more proximity sensors, or one or more LIDAR sensors that determine the movement of the head of the listener based on a LIDAR field. Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments can be embodied as a system, method, or computer program product. Accordingly, aspects of the present disclosure can take the form of an entirely hardware embodiment, an entirely software embodiment (including firmware, resident software, microcode, etc.) or an embodiment combining software and hardware aspects that can all generally be referred to herein as a "module," a "system," or a "computer." In addition, any hardware and/or software technique, process, function, component, engine, module, or system described in the present disclosure can be implemented as a circuit or set of circuits. Furthermore, aspects of the present disclosure can take the form of a computer program product embodied in one or more computer readable medium(s) having computer readable program code embodied thereon.

Any combination of one or more computer readable medium(s) can be utilized. The computer readable medium can be a computer readable signal medium or a computer readable storage medium. A computer readable storage medium can be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium can be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions can be provided to a processor of a general purpose computer, special purpose computer, or other programmable data processing apparatus to produce a machine. The instructions, when executed via the processor of the computer or other programmable data processing apparatus, enable the implementation of the functions/acts specified in the flowchart and/or block diagram block or blocks. Such processors can be, without limitation, general purpose processors, special-purpose processors, application-specific processors, or field-programmable gate arrays.

The flowchart and block diagrams in the figures illustrate the architecture, functionality, and operation of possible implementations of systems, methods, and computer program products according to various embodiments of the present disclosure. In this regard, each block in the flowchart or block diagrams can represent a module, segment, or portion of code, which comprises one or more executable instructions for implementing the specified logical function(s). It should also be noted that, in some alternative implementations, the functions noted in the block can occur out of the order noted in the figures. For example, two blocks shown in succession may, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure can be devised without departing from the basic scope thereof, and the scope thereof is determined by the claims that follow.

What is claimed is:

1. A computer-implemented method of controlling an active noise cancellation (ANC) system, the method comprising:

determining a noise within a vehicle;

detecting a movement of a head of a listener;

adjusting one or more parameters of the ANC system based at least on the noise and the movement of the head of the listener;

determining an anti-noise based at least on the adjusted one or more parameters; and outputting the anti-noise;

wherein adjusting the one or more parameters includes refraining from generating the anti-noise in a frequency range based at least on the movement of the head of the listener exceeding a movement threshold.

2. The computer-implemented method of claim 1, wherein determining the noise within the vehicle includes detecting one or more of, a road noise field of road noise within the vehicle, or an engine noise field of an engine noise within the vehicle.

3. The computer-implemented method of claim 1, wherein detecting the movement of the head of the listener includes detecting one or more of, a position change of the head of the listener, a speed of the position change of the head of the listener, an acceleration of the position change of the head of the listener, an orientation change of the head of the listener, a speed of the orientation change of the head of the listener, or an acceleration of the orientation change of the head of the listener.

4. The computer-implemented method of claim 1, wherein adjusting the one or more parameters further includes:

determining a cutoff frequency based on at least on the noise and the movement of the head of the listener; and applying, to the anti-noise, a low-pass filter based on the cutoff frequency.

5. The computer-implemented method of claim 1, wherein adjusting the one or more parameters further includes, adjusting a first parameter of the one or more parameters of a road noise cancellation feature of the anti-noise based at least on the movement of the head of the listener, and adjusting a second parameter of the one or more parameters of an engine noise cancellation feature of the anti-noise based at least on the movement of the head of the listener.

6. The computer-implemented method of claim 1, wherein adjusting the one or more parameters further includes, refraining from generating a road noise cancellation component of the anti-noise based at least on the movement of the head of the listener exceeding a first movement threshold, and refraining from generating an engine noise cancellation component of the anti-noise based at least on the movement of the head of the listener exceeding a second movement threshold that is higher than the first movement threshold.

7. The computer-implemented method of claim 1, wherein adjusting the one or more parameters further includes, determining an occurrence frequency of the movement of the head of the listener, and further adjusting the one or more parameters based at least on the occurrence frequency.

8. A non-transitory computer readable medium storing instructions that, when executed by a processor, cause the processor to perform the steps of:

determining a noise within a vehicle;

detecting a movement of a head of a listener;

based at least on the noise and the movement of the head of the listener, adjusting one or more parameters of an active noise cancellation (ANC) system;

determining an anti-noise based at least on the adjusted one or more parameters; and outputting the anti-noise;

wherein adjusting the one or more parameters includes refraining from generating the anti-noise in a frequency range based at least on the movement of the head of the listener exceeding a movement threshold.

9. The non-transitory computer readable medium of claim 8, wherein adjusting the one or more parameters further includes adjusting the one or more parameters based at least on an adaptation rate of the ANC system.

10. The non-transitory computer readable medium of claim 8, wherein adjusting the one or more parameters further includes, deactivating a first anti-noise generator of the ANC system that generates a first anti-noise frequency based at least on the movement of the head of the listener exceeding a first movement threshold, and deactivating a second anti-noise generator of the ANC system that generates a second anti-noise frequency based at least on the movement of the head of the listener exceeding a second movement threshold, the second anti-noise frequency being lower than the first anti-noise frequency.

11. The non-transitory computer readable medium of claim 8, wherein adjusting the one or more parameters further includes adjusting the one or more parameters in proportion with the movement of the head of the listener.

12. The non-transitory computer readable medium of claim 8, wherein adjusting the one or more parameters further includes includes refraining from generating frequencies of the anti-noise above a cutoff frequency based at least on the movement of the head of the listener.

13. The non-transitory computer readable medium of claim 8, wherein adjusting the one or more parameters further includes attenuating an upper-frequency band of the anti-noise based at least on the movement of the head of the listener exceeding the movement threshold.

14. The non-transitory computer readable medium of claim 8, wherein adjusting the one or more parameters further includes adjusting the one or more parameters based at least on a preference of the listener.

15. The non-transitory computer readable medium of claim 8, wherein adjusting the one or more parameters further includes adjusting a noise input of the ANC system by adjusting one or both of, one or more noise sensors that determine the noise within the vehicle, or a noise input to an anti-noise generator of the ANC system that determines the anti-noise.

16. The non-transitory computer readable medium of claim 8, wherein adjusting the one or more parameters further includes adjusting an anti-noise output of the ANC system by adjusting one or both of, an anti-noise output of an anti-noise generator of the ANC system that determines the anti-noise, or an anti-noise output of the ANC system that outputs the anti-noise.

17. An active noise cancellation (ANC) system, comprising:

one or more noise sensors that determine a noise within a vehicle;

one or more movement sensors that detect a movement of a head of a listener;

one or more anti-noise generators that, based at least on the noise and the movement of the head of the listener, adjust one or more parameters of the ANC system, determine an anti-noise based at least on the adjusted one or more parameters; and based at least on the movement of the head of the listener exceeding a movement threshold, refrain from generating the anti-noise in a frequency range; and one or more anti-noise outputs that output the anti-noise.

18. The ANC system of claim 17, wherein the one or more noise sensors include one or both of, one or more microphones that determine the noise based on audio input, or one or more vehicle sensors that each map one or more vehicle metrics to a determination of at least a part of the noise or the anti-noise.

19. The ANC system of claim 17, wherein the one or more movement sensors include one or more of, one or more camera that determine the movement of the head of the listener based on images of the head of the listener, one or more proximity sensors that determine the movement of the head of the listener based on a proximity of the head of the listener to the one or more proximity sensors, or one or more LIDAR sensors that determine the movement of the head of the listener based on a LIDAR field.

* * * * *